US005933156A

United States Patent [19]

Margolin

[11] Patent Number: 5,933,156

[45] Date of Patent: Aug. 3, 1999

[54] Z-BUFFER FOR ROW ADDRESSABLE GRAPHICS MEMORY WITH FLASH FILL

[76] Inventor: Jed Margolin, 3570 Pleasant Echo Dr., San Jose, Calif. 95148-1916

[21] Appl. No.: 08/984,170

[22] Filed: Dec. 3, 1997

[51] Int. Cl.[6] ..... G09G 5/36

[52] U.S. Cl. ..... 345/509; 345/422; 345/515

[58] Field of Search ..... 345/422, 507–509, 345/515, 516

[56] References Cited

U.S. PATENT DOCUMENTS

| | | | |
|---|---|---|---|
| 3,889,107 | 6/1975 | Sutherland | 345/425 |
| 3,996,672 | 12/1976 | Osofsky et al. | 434/43 |
| 4,152,766 | 5/1979 | Osofsky et al. | 365/44 |
| 4,625,289 | 11/1986 | Rockwood | 345/422 |
| 4,679,041 | 7/1987 | Fetter et al. | 345/139 |
| 4,825,391 | 4/1989 | Merz | 345/431 |
| 4,924,415 | 5/1990 | Winser | 345/422 |
| 4,951,232 | 8/1990 | Hannah | 345/422 |
| 4,961,153 | 10/1990 | Fredrickson et al. | 345/422 |
| 5,038,297 | 8/1991 | Hannah | 345/422 |
| 5,043,921 | 8/1991 | Gonzalez-Lopez et al. | 345/422 |
| 5,043,922 | 8/1991 | Matsumoto | 345/422 |
| 5,081,698 | 1/1992 | Kohn | 345/422 |
| 5,157,388 | 10/1992 | Kohn | 345/422 |
| 5,245,700 | 9/1993 | Fossum | 345/422 |
| 5,271,094 | 12/1993 | Albaugh et al. . | |
| 5,301,263 | 4/1994 | Dowdell | 345/422 |
| 5,329,613 | 7/1994 | Brase et al. | 345/422 |
| 5,339,386 | 8/1994 | Sodenberg et al. | 345/422 |
| 5,341,462 | 8/1994 | Obata | 345/422 |
| 5,371,514 | 12/1994 | Lawless et al. | 345/145 |
| 5,377,313 | 12/1994 | Scheibl | 345/422 |
| 5,402,532 | 3/1995 | Epstein et al. | 345/422 |
| 5,416,893 | 5/1995 | Herrell et al. | 345/422 |
| 5,422,998 | 6/1995 | Margolin | 345/519 |
| 5,471,567 | 11/1995 | Soderberg et al. | 345/422 |
| 5,493,644 | 2/1996 | Thayer et al. | 345/422 |
| 5,537,520 | 7/1996 | Doi et al. | 345/422 |
| 5,542,025 | 7/1996 | Brown | 345/422 |
| 5,544,306 | 8/1996 | Deering et al. | 345/507 |
| 5,546,530 | 8/1996 | Grimaud et al. | 345/422 |
| 5,553,229 | 9/1996 | Margolin | 345/516 |
| 5,596,686 | 1/1997 | Duluk | 345/422 |

OTHER PUBLICATIONS

Newman and Sproul, Principles of Interactive Computer Graphics, 1979, pp. 369–371, McGraw–Hill, ISBN 0–07–046338–7.

IBM Press Announcement, "IBM, Siemens, and Toshiba alliance announces smallest fully functional 256Mb DRAM chip," Jun. 6, 1995, from IBM Web site: http://www.chips-.ibm.com/news/news.256meg.html.

*Primary Examiner*—Kee M. Tung

[57] ABSTRACT

A Z-Buffer is added to a Row Addressable Graphics Memory With Flash Fill so that a Z (or Depth) value is supplied with each Start and End address. The Z value is calculated for each pixel between the Start and End address. This value is compared to the existing Z value for that pixel stored in the Z-Buffer. Values less than the existing value replace the Z value for that pixel in the Z-Buffer and allow the new pixel to be written into the display memory. The Z data are read, modified, and written back to the Z-Buffer in parallel thereby requiring a maximum of three memory cycles to operate on a line segment independent of the length of the line.

10 Claims, 19 Drawing Sheets

1024 stages x 16 bits
10
Z Memory Array
1024 x 768
x 16 bits
Row Address
R/Wn
En
CFsel
12
Z Comparators
1024 stages
(1024)
11
NEW Z Values
1024 stages
x 16 bits
KZ
dz
14
ZCOMP
Address Compare
Units (1024)
PEnable
13
New Z
Old Z
ZCOMP
ZEnable
Z Select Unit
Z Preset Data
Out
Preset All Z
15
Z Preset
Register
(16 bits)
ZP
Data
ZP
Clk
Z_ Preset
16
Z Latch
1024 x 16
In
Out
Clk
OE
ZLOE
ZLClk 20
Memory Array
2 x 1024 x 768 x 24
ADR
R/Wn
/CS
Data 1024 x 24
Data (1024 x 24 bits)
Row Address 10 Bits
R/Wn
/CS
21
CLK
Latch 1024 x 24
/LCLK
1024 x 24 Bits
22
Data In 1024 x 24 bits
Fill Unit
(1024 Stages x 24 bits)
Data Out 1024 x 24
/FOE F1 /F1 F0 /F0
Start Address 10 Bits
End Address 10 Bits
Color 24 Bits
/FOE
F1
/F1 F0 /F0
23
Shift Register 1024x24
Sin
Sout
/SDen
SCLK
R/Wn/LD
'0's
Serial Out 24 bits
Serial OE
Serial CLK
/SRTFR
SR_R/Wn

| n | NEW Z |
|---|---|
| 0 | ZSm + (0 - XSm) x dz |
| 1 | Z0+dz |
| 2 | Z1+dz |
| 3 | Z2+dz |
| 4 | ZSm + (4 - XSm) x dz |
| 5 | Z4+dz |
| 6 | Z5+dz |
| 7 | Z6+dz |
| .... | |
| 1020 | ZSm + (1020 - XSm) x dz |
| 1021 | Z1020+dz |
| 1022 | Z1021+dz |
| 1023 | Z1022+dz |

Fig. 12b

| n | NEW Z |
|---|---|
| 0 | ZSm + (0 - XSm) x dz |
| 1 | ZSm + (1 - XSm) x dz |
| 2 | ZSm + (2 - XSm) x dz |
| 3 | ZSm + (3 - XSm) x dz |
| 4 | ZSm + (4 - XSm) x dz |
| 5 | ZSm + (5 - XSm) x dz |
| 6 | ZSm + (6 - XSm) x dz |
| 7 | ZSm + (7 - XSm) x dz |
| .... | |
| 1020 | ZSm + (1020 - XSm) x dz |
| 1021 | ZSm + (1021 - XSm) x dz |
| 1022 | ZSm + (1022 - XSm) x dz |
| 1023 | ZSm + (1023 - XSm) x dz |

Fig. 12a

Z-BUFFER FOR ROW ADDRESSABLE GRAPHICS MEMORY WITH FLASH FILL

CROSS REFERENCES TO RELATED PATENTS

U.S. Pat. No. 5,422,998 VIDEO MEMORY WITH FLASH FILL issued Jun. 6, 1995 and U.S. Pat. No. 5,553,229 ROW ADDRESSABLE GRAPHICS MEMORY WITH FLASH FILL issued Sep. 3, 1996. Both are issued to the present applicant and are hereby incorporated by reference.

BACKGROUND OF THE INVENTION

1. Field of Invention

This invention relates to a memory device for high performance real-time graphics systems for displaying flat-shaded polygons, typically used for, but not limited to, the display of 3D graphics. More specifically, this invention relates to a Z-Buffer, so named because most three dimensional systems use coordinate axes oriented so that the Z axis points straight ahead. However, because some systems do not have the Z axis pointing straight ahead, the term Depth Buffer is a more general description. Nonetheless, for the purposes of this application the terms Depth Buffer and Z-Buffer will mean the same thing.

2. Discussion of Prior Art

When displaying polygons representing 3D surfaces it is common that some polygons obscure other polygons, either partially or completely. In order for the result to be realistic it is necessary that the obscured (or hidden) surfaces not be drawn.

A simple method is to sort the polygons according to their distance to the viewer. The polygons that are the farthest from the viewer are drawn into the frame buffer first. The polygons that are closest to the viewer are drawn last, thereby having the opportunity of overwriting any polygons (either whole or in part) that are farther away.

There are two problems with simple polygon sorting. One is that it is computationally intensive for large numbers of polygons. The other problem is that polygons that intersect are not handled properly. The polygon that is drawn last will dominate.

A method for dealing with this second problem is taught in U.S. Pat. No. 3,889,107 SYSTEM OF POLYGON SORTING BY DISSECTION, issued Jun. 10, 1975 to Sutherland. In this method any polygon which straddles a plane of subdivision is dissected into two parts which are thereafter treated separately.

An early reference to the use of Z-Buffers can be found in the textbook by Newman & Sproull, "Principles of Interactive computer Graphics (Second Edition)" McGraw-Hill, 1979., pp. 369–371.

"Of all image-space algorithms, the depth buffer algorithm is the simplest. For each pixel on the display screen, we keep a record of the depth of the object within the pixel that lies closest to the observer. In addition to the depth, we also record the intensity that should be displayed to show the object. In this respect, the depth-buffer is an extension of a frame buffer.

The depth-buffer algorithm given below requires two arrays, intensity and depth, each of which is indexed by pixel coordinates (x,y).

Depth Buffer Algorithm

1. For all pixels on the screen, set depth[x,y] to 1.0 and intensity[x,y] to a background value.
2. For each polygon in the scene, find all pixels (x,y) that lie within the boundaries of the polygon when projected onto the screen. For each of these pixels:

a. Calculate the depth z of the polygon at (x,y).
b. If z<depth[x,y], this polygon is closer to the observer than others already recorded for this pixel. In this case, set depth[x,y] to z and intensity[x,y] to a value corresponding to the polygon's shading. If instead z>depth[x,y], the polygon already recorded at (x,y) lies closer to the observer than does this new polygon, and no action is taken."

Since then, there have been numerous patents concerning Z-Buffers. They range from purely software methods to methods incorporating specialized hardware. What almost all of them have in common is that they use conventional computer memories.

An example of a combination software and hardware method is shown in U.S. Pat. No. 5,081,698 METHOD AND APPARATUS FOR GRAPHICS DISPLAY DATA MANIPULATION, issued Jan. 14, 1992 to Kohn. This patent teaches that a portion of a single chip processor is physically dedicated to graphics oriented processing, and a set of graphics oriented instructions are provided that substantially accelerate the graphics pipeline throughput.

A method incorporating specialized hardware is taught in U.S. Pat. No. 4,924,415 APPARATUS FOR MODIFYING DATA STORED IN A RANDOM ACCESS MEMORY, issued May 8, 1990 to Winser. This method uses standard VRAMs to implement a pipelined Z-Buffer for Hidden Surface Removal (HSR). The VRAM serial access port is used synchronously with the writing operations to the main array to extract the current z-values from the main z-RAM array rather than for repetitive display refresh purposes.

A method that does not use conventional computer memories is shown in U.S. Pat. No. 5,544,306 FLEXIBLE DRAM ACCESS IN A FRAME BUFFER MEMORY AND SYSTEM, issued Aug. 6, 1996 to Deering et al. This is a Z-buffer IC that performs the Z compare internally instead of in software. The Frame Buffer Memory (FBRAM) uses four DRAMs of conventional design along with a high speed SRAM cache and a pixel ALU. Although the FBRAM does not use conventional memories as such, the internal DRAMs are of conventional design.

Another method that does not use conventional computer memories is shown in U.S. Pat. No. 5,596,686 METHOD AND APPARATUS FOR SIMULTANEOUS PARALLEL QUERY GRAPHICS RENDERING Z-COORDINATE BUFFER issued Jan. 21, 1997 to Duluk. Duluk uses a specialized IC called a "Magnitude Comparison Content Addressable Memory" (MCCAM) which determines whether or not a polygon is obscured by previous polygons before handing it over to a rendering engine. If the polygon is obscured by previous polygons, no further action is required. If the polygon is not obscured by previous polygons, the rendering engine renders it and uses a second (standard) Z-Buffer along with a frame buffer of standard design. This is shown in Duluk FIG. 14. The MCCAM does the comparison on all polygon points simultaneously. However, getting points into and out of the MCCAM can be slow.

"The main drawback to reading every Pixel Hit out of the MCCAM Z-buffer 11000, 23000, or 39000 is similar to the above described drawback to the one-by-one writing of new z-values into the MCCAM Z-buffer 11000, 23000, or 39000. Reading (or writing) all the Pixel Hits can consume a major fraction of the memory access bandwidth of the MCCAM Z-buffer 11000, 23000, or 39000." See Column 28, lines 60–67.

The operation of a Row Addressable Graphics Memory With Flash Fill is taught in U.S. Pat. NO. 5,422,998 VIDEO MEMORY WITH FLASH FILL issued Jun. 6, 1995 and U.S. Pat. NO. 5,553,229 ROW ADDRESSABLE GRAPHICS MEMORY WITH FLASH FILL issued Sep. 3, 1996, both issued to the present applicant. A Row Addressable Graphics Memory With Flash Fill is a single-chip semiconductor memory device optimized for high performance flat-shaded polygon video systems and consists of a RAM with flash fill circuitry whereby the Start and End addresses are specified for a given row; the data within this range are read, modified, and written back to the memory in parallel thereby requiring a maximum of three memory cycles to fill a line segment independent of the length of the line. The data are modified according to a function between a color register and the data already present in the memory array, the functions being: AND, OR, EXCLUSIVE OR, or REPLACE.

With the exception of the Duluk patent, prior art Z-Buffers use conventional computer memories which limit the number of Z values that can be accessed in each memory cycle. For example, even with a 64-bit data path, a system having 16-bit Z values can only access four Z values per memory access. Even in the Duluk patent, the amount of data that can be accessed before sending it to the second (standard) Z-Buffer is limited by the size of the data bus.

OBJECTS AND ADVANTAGES

Accordingly, one of the objects and advantages of my invention is to eliminate the bandwidth bottleneck between a Z-Buffer and a pixel frame buffer by adding a Z-Buffer to a Row Addressable Graphics Memory With Flash Fill so that all of the pixel frame buffer operations and Z-Buffer operations are performed in parallel regardless of the length of the line being filled.

Further objects and advantages of my invention will become apparent from a consideration of the drawings and ensuing description.

SUMMARY

A Row Addressable Graphics Memory With Flash Fill that includes a Z-Buffer is described.

A Row Addressable Graphics Memory With Flash Fill is a single-chip semiconductor memory device optimized for high performance flat-shaded polygon video systems and consists of a RAM with flash fill circuitry whereby the Start and End addresses are specified for a given row; the data within this range are read, modified, and written back to the memory in parallel thereby requiring a maximum of three memory cycles to fill a line segment independent of the length of the line. The data are modified according to a function between a color register and the data already present in the memory array, the functions being: AND, OR, EXCLUSIVE OR, or REPLACE.

A Z-Buffer is added so that a Z (or Depth) value is supplied with each Start and End Address. The Z value is calculated for each pixel between the Start and End address. This value is compared to the existing Z value for that pixel stored in the Z-Buffer. Values less than the existing value replace the Z value for that pixel in the Z-Buffer and allow the new pixel to be written into the display memory. The Z data are read, modified, and written back to the Z-Buffer in parallel thereby requiring a maximum of three memory cycles to operate on a line segment independent of the length of the line.

The interpolation of the Z values between $Z_{13}$ Start and Z_End for the line segment being drawn is performed by a combination of shifts and adds selected to produce an acceptable propagation delay with an acceptable number of adders.

BRIEF DESCRIPTION OF THE DRAWINGS

The invention may best be understood by referring to the following description and accompanying drawings which are used to illustrate the invention.

In the drawings:

FIG. 12*a* shows the method of FIG. 11 where the granularity is equal to 1.

FIG. 12*b* shows the method of FIG. 11 where the granularity is equal to 4.

DETAILED DESCRIPTION

Figure 3:
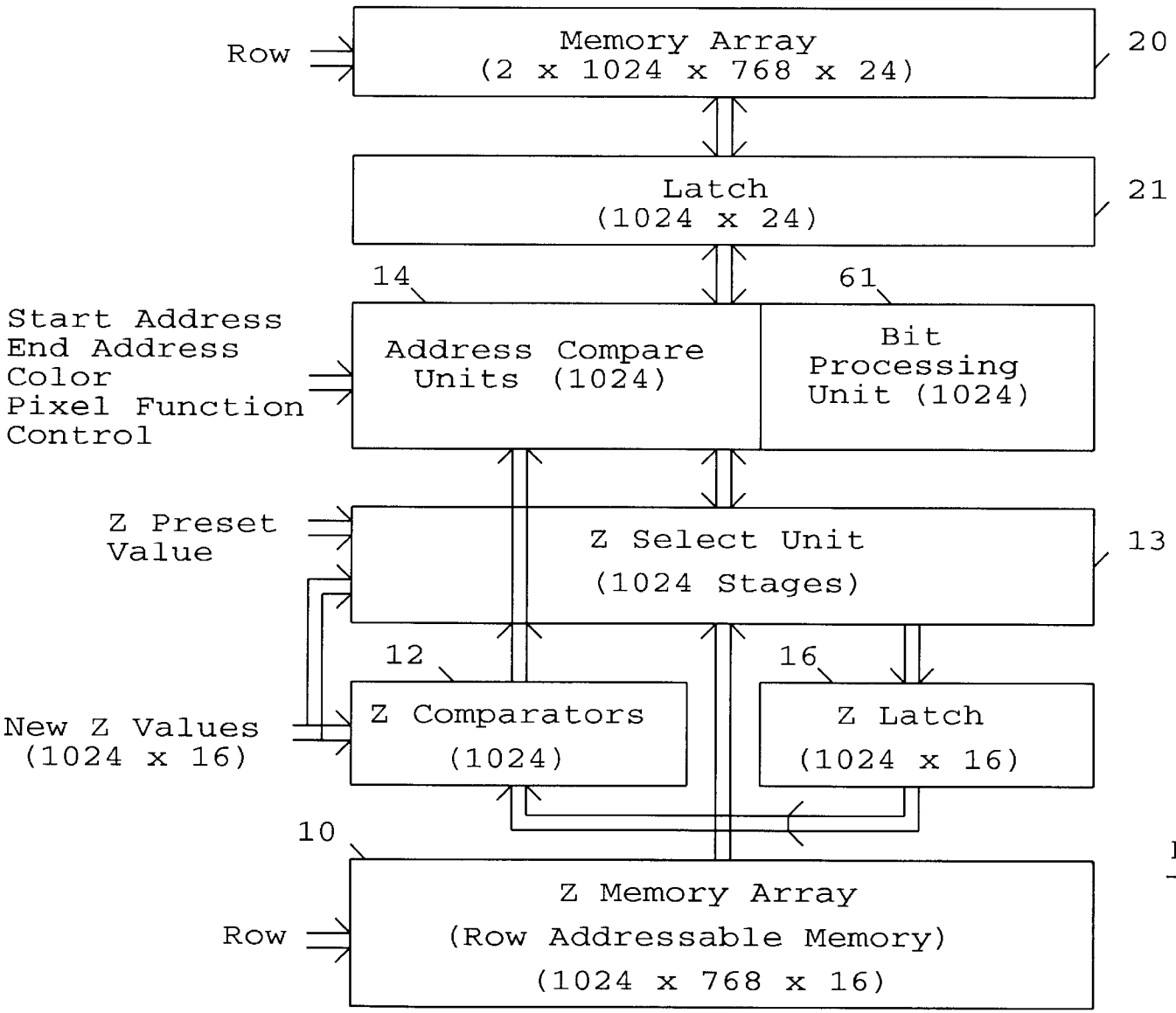
FIG. 3 is a general block diagram for the invention.

In the following description, numerous specific details are set forth to provide a thorough understanding of the invention. However, it is understood that the invention may be practiced without these specific details. In other instances, well-known circuits, structures and techniques have not been shown in detail in order not to obscure the invention FIG. 3 shows the general operation of the present invention. A Row Address is simultaneously applied to Memory Array 20 (containing the pixel data) and to Z Memory Array 10 (containing the Z value for each pixel). The Start Address, End Address, Color, and Pixel Function are supplied to Address Compare Units 14. The New Z Values for each of the 1024 stages are supplied to Z Comparators 12. For each stage, Address Compare Units 14 determines whether it is within the range of the Start Address and End Address. For stages that are outside this range, Bit Processing Unit 61 will write the original pixel data back into Memory Array 20 and Z Select Unit 13 will write the old Z data back into Z Memory Array 10. For stages that are within this range, Z Select Unit 13 will determine, for each stage, whether the new pixel's Z value is closer to the observer than is the old pixel's Z value. If the new pixel's Z value is closer to the observer than is the old pixel's Z value, Bit Processing Unit 61 will allow the new pixel information to be written into Memory Array 20 and Z Select Unit 13 will allow the new Z information to be written into Z Memory Array 10. These decisions are made for each of the 1024 stages individually and simultaneously. Both Memory Array 20 and Z Memory Array 10 have modes that allow them to be preset to selected values, on a row by row basis.

Row Addressable Graphics Memory With Flash Fill

The operation of a Row Addressable Graphics Memory With Flash Fill is fully described in U.S. Pat. No. 5,422,998 VIDEO MEMORY WITH FLASH FILL issued Jun. 6, 1995 and U.S. Pat. No. 5,553,229 ROW ADDRESSABLE GRAPHICS MEMORY WITH FLASH FILL issued Sep. 3, 1996, both issued to the present applicant. The operation of one implementation of a Row Addressable Graphics Memory With Flash Fill is as follows.

Figure 2:
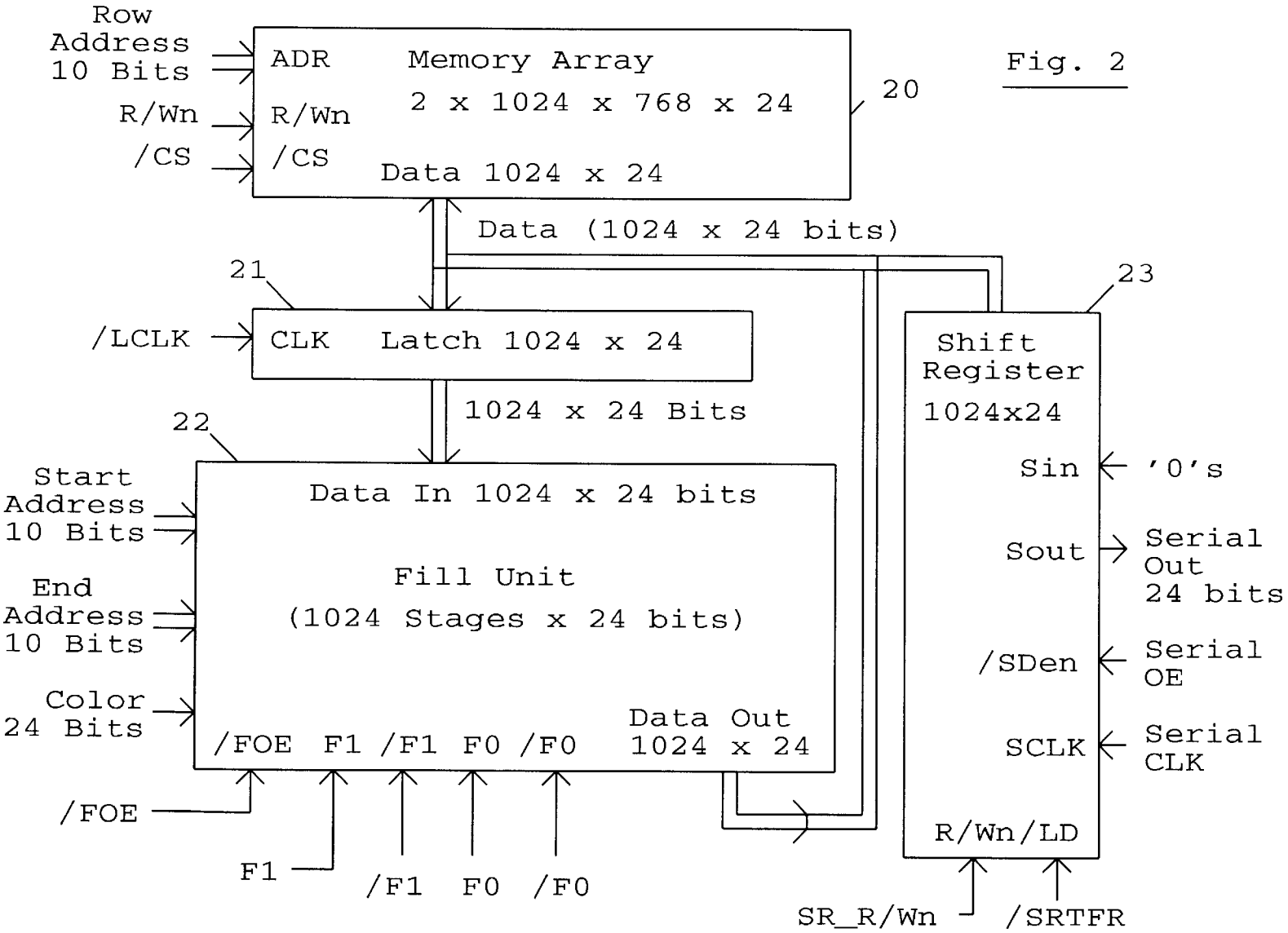
FIG. 2 is a block diagram of a Row Addressable Graphics Memory With Flash Fill that includes dual display buffers with 24 bit-planes.

FIG. 2 shows the basic form of a Row Addressable Graphics Memory With Flash Fill. Memory Array 20 is organized as two buffers of 1024 by 768 by 24 bits and contains the row address decoders and sense amplifiers of conventional design. However, all 1024 column data lines are used in parallel and therefore are not further decoded by column address decoders. The basic Flash-Fill operation consists of supplying a Row Address to Memory Array 20 in the Read mode, latching all 1024 output stages of 24 bits in Latch 21, modifying the data in Fill Unit 22, and writing the result back into Memory Array 20 in the Write mode.

While any number of techniques can be used for supplying the pixel data to the video display, in one implementation a Row Address is supplied to Memory Array 20 and the output data are latched into Shift Register 23. The pixel data are then shifted out to the video display circuitry independently of the operation of the Memory Array.

Figure 6:
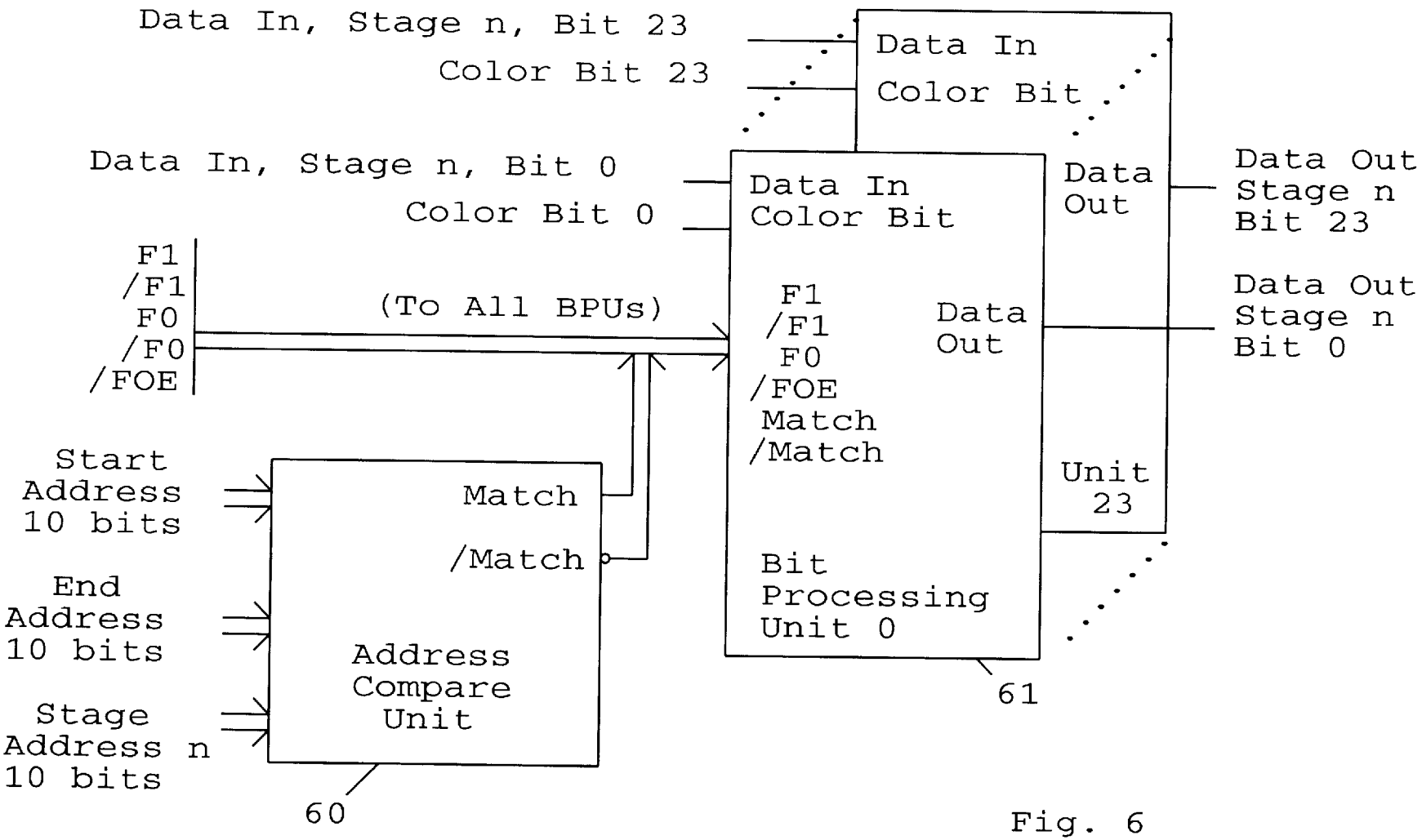
FIG. 6 is a block diagram of a stage of a Fill Unit for a Row Addressable Graphics Memory With Flash Fill.

Each stage of Fill Unit 22 in FIG. 2 is composed of Address Compare Unit 60 and Bit Processing Unit 61 in FIG. 6. Address Compare Unit 60 in FIG. 6 is shown in greater detail in FIG. 7. Comparator 70 produces an output when the address of Stage_n is greater than or equal to the Start_address. Comparator 71 produces an output when the End_address is greater than or equal to the address of Stage_n. When both of these conditions are true, AND gate 72 produces output 'Match' to indicate that the Stage_n address is greater than or equal to the Start_address and also less than or equal to the End_address. Inverter 73 produces the complement of 'Match'.

When the address for the stage is within the matching range, the data for the pixel associated with that stage are operated on by Bit Processing Unit 61 in FIG. 6. These operations may be selected to be: AND, OR, EXCLUSIVE OR, or REPLACE.

Note that although each bit-plane requires its own Bit Processing Unit, only one Address Compare Unit 60 is needed for each 24-bit pixel.

While an implementation has been described having specific dimensions (e.g. Memory Array 20 is shown as being 2×1024×768×24) alternative implementations can have different dimensions.

Z-Buffer

Figure 1:
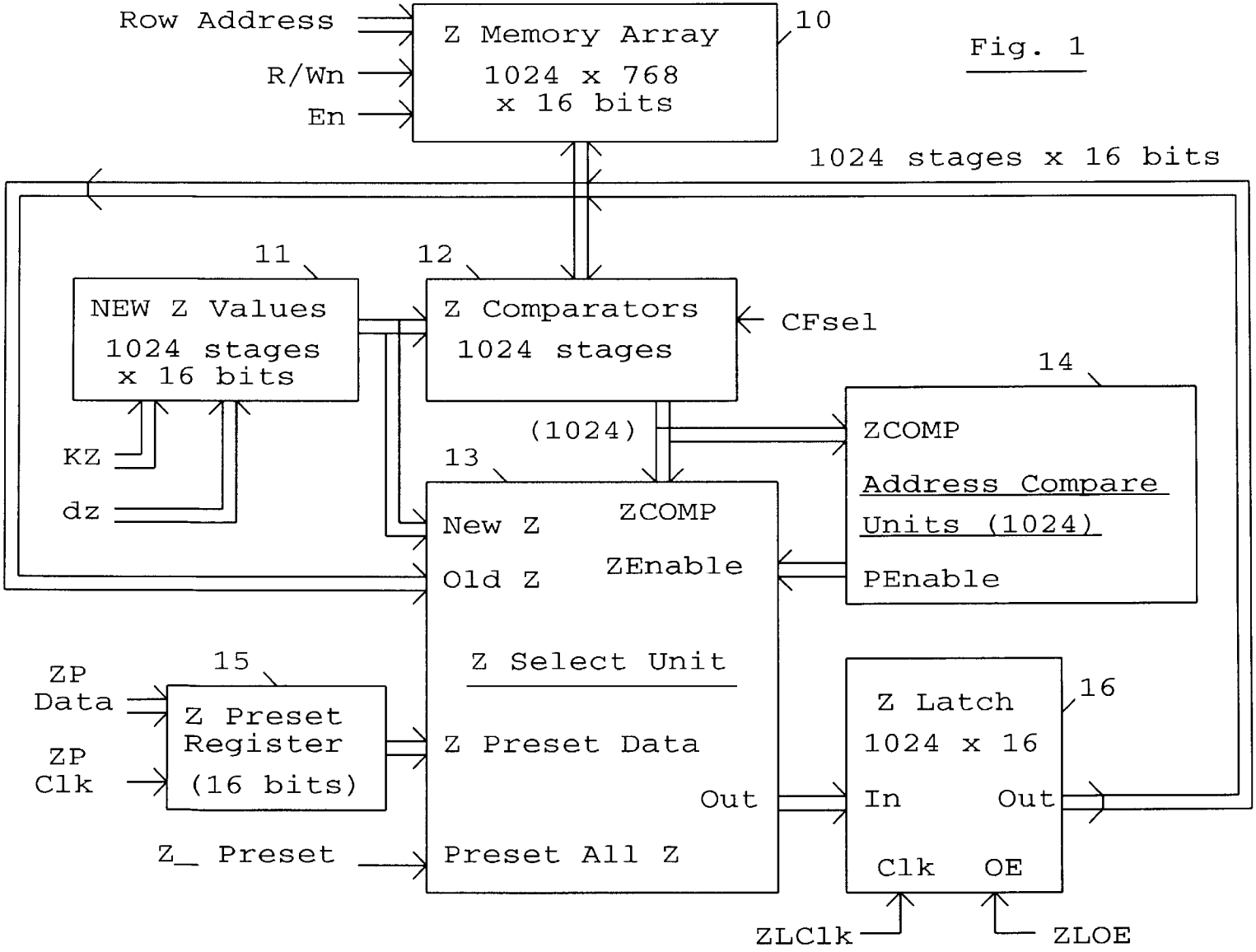
FIG. 1 is a general illustration showing a 16 bit Flash-Fill Z-Buffer with 1024 stages.

FIG. 1 shows the form of the Z-buffer. Z Memory Array 10 is a random access memory array using either static or dynamic memory cells, having 1024 columns of 768 rows and being 16 bits deep. Each row that is addressed accesses 1024 columns (or stages), each 16 bits deep. The 1024 stages are all accessed simultaneously.

NEW Z Values 11 is an array of adders and shifters that calculates the new Z values of each of the 1024 stages simultaneously. The method by which the new Z values are calculated will be discussed later in more detail in the section entitled "Z-BUFFER MATH."

Z Comparators 12 contains 1024 comparators and compares the old Z values from Z Memory Array 10 with the new Z values from NEW Z Values 11. All 1024 comparators operate simultaneously. Each comparator performs a comparison of two 16 bit numbers. Normally a smaller Z value is closer to the observer than a larger Z value. However, because some 3D systems consider a larger Z value to be closer than a smaller Z value, input 'CFsel' is used to select either relationship. The following discussion assumes that a smaller Z value is closer than a larger Z value.

Figure 4:
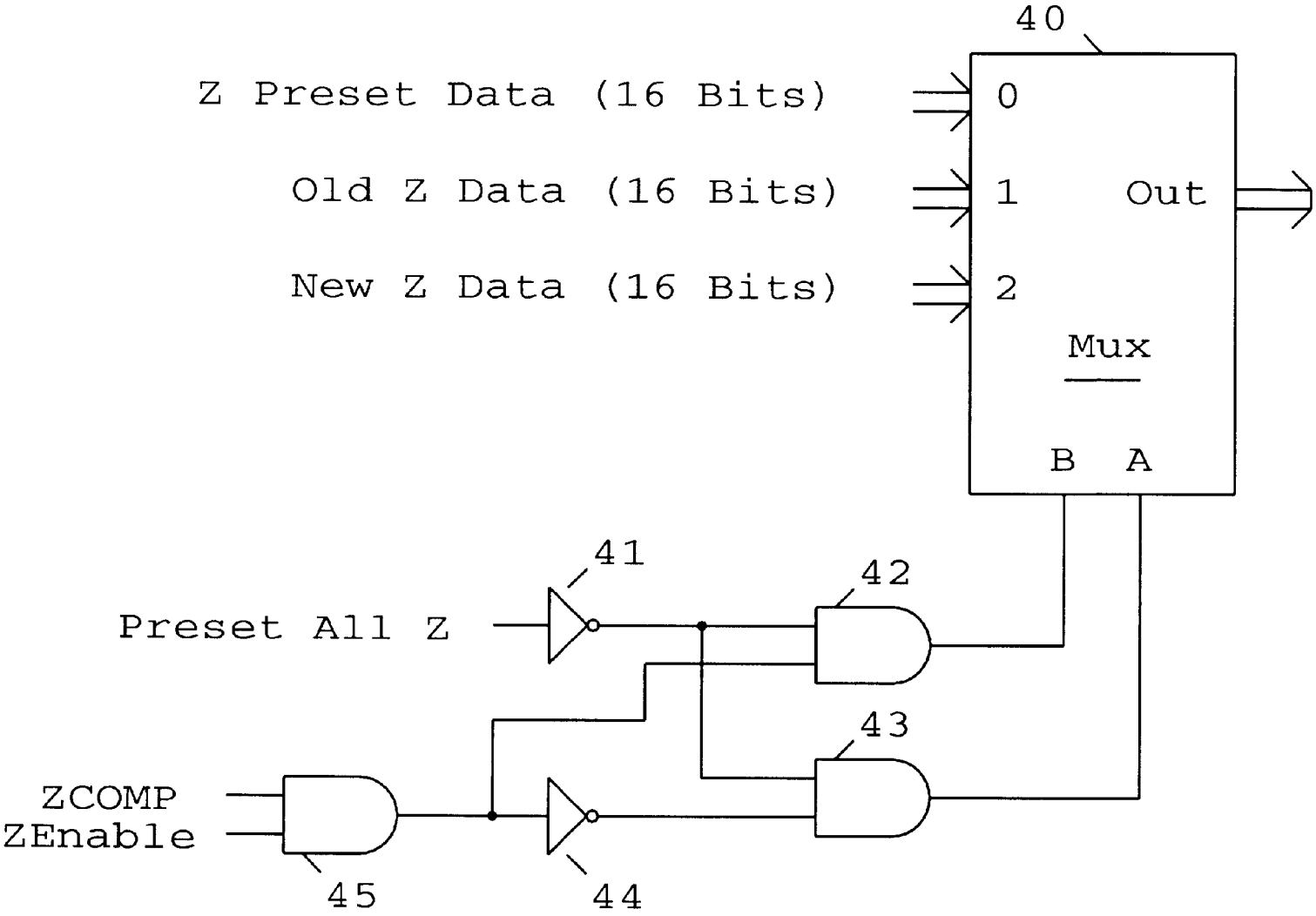
FIG. 4 is a block diagram of a stage of a Z-Select Unit.

Z Select Unit 13 is composed of 1024 stages of the type shown in FIG. 4. As illustrated in FIG. 4, Mux 40 selects either 'Old Z Data', 'New Z Data', or 'Z Preset Data'. When the signal 'Preset All Z' is asserted, Inverter 41, AND Gate 42, and AND Gate 43 cause Mux 40 to select 'Z Preset Data'. When 'Preset All Z Data' is not asserted, Mux 40 will select either 'Old Z Data' or 'New Z Data'. In this case, when 'ZEnable' is not asserted, AND Gate 45, Inverter 44, AND Gate 43, and AND Gate 42 will cause Mux 40 to select 'Old Z Data'. When both 'ZEnable' and 'ZCOMP' are asserted, AND Gate 45, Inverter 44, AND Gate 43, and AND Gate 42 will cause Mux 40 to select 'New Z Data'.

Returning to FIG. 1, for each of the 1024 stages (referred to as "stage addresses") Z Select Unit 13 has several operating modes.

In one mode:

a. For stage addresses that are outside the address range of the line segment being drawn, Address Compare Units 14 causes the output of Z Select Unit 13 to be the old Z values from Z Memory Array 10. This data will be presented to Z Latch 16 which contains 1024 stages of 16 bits each.

b. For stage addresses that are within the address range of the line segment being drawn, Address Compare Units 14 will cause Z Select Unit 13 to utilize the signals from Z Comparators 12. For stages in which the old Z value is smaller than the new Z value, the old Z value will be output. For stages in which the new Z value is smaller than the old Z value, the new Z value will be output.

In another mode, all data presented to Z Latch 16 will come from Z Preset Register 15. This is to allow the data in Z Memory Array 10 to be set to a predetermined value.

After the data from Z Select Unit 13 are latched in Z Latch 16, the data from Z Latch 16 are written back to Z Memory Array 10. As per the previous discussion this data may be any combination of the old Z data, new Z data from NEW Z Values 11, or new Z data from Z Preset Register 15.

Figure 9:
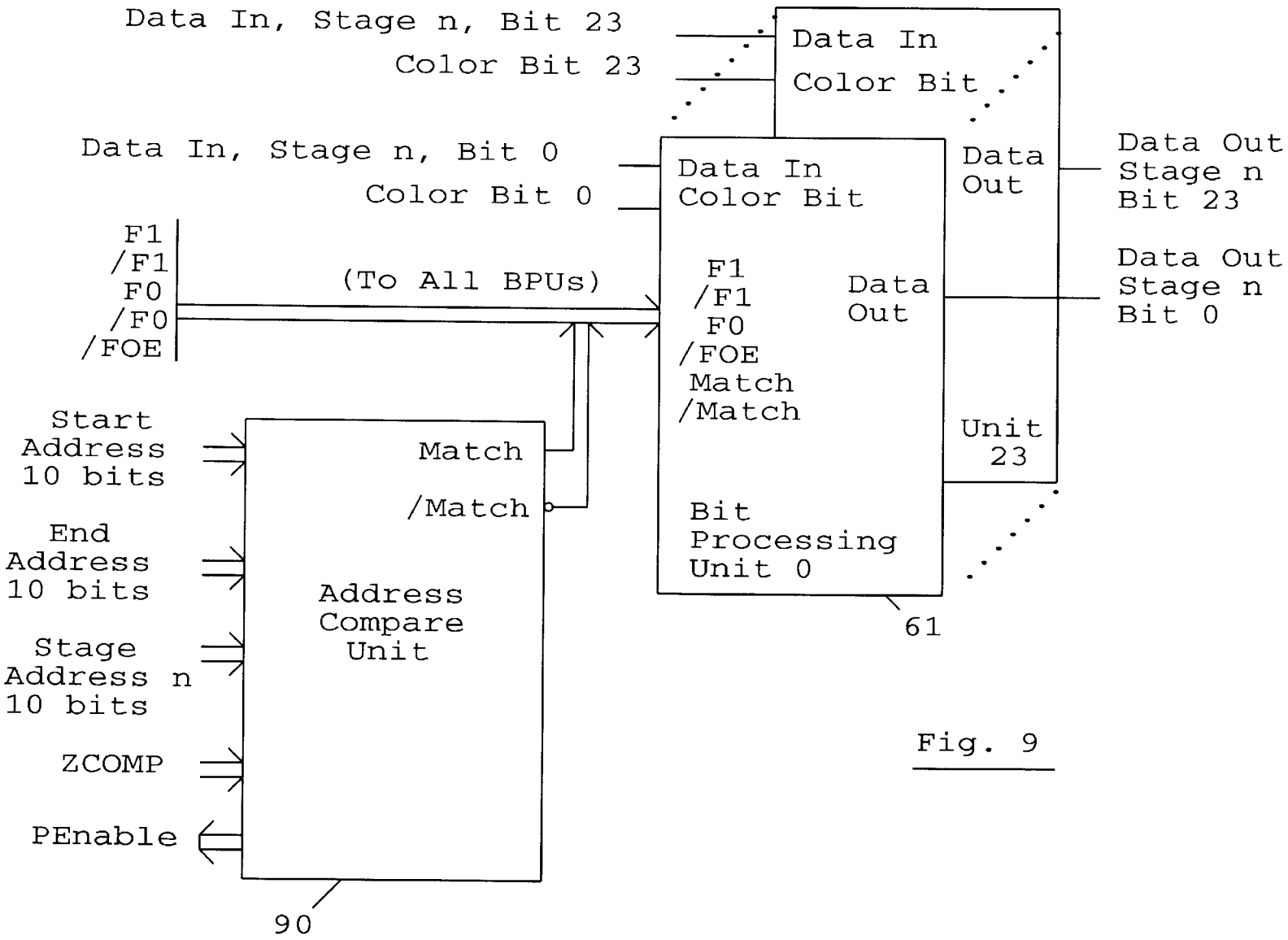
FIG. 9 is a block diagram of a Fill Unit for a Row Addressable Graphics Memory With Flash Fill including a Z-Buffer.

When new Z data from NEW Z Values 11 are written back to Z Memory Array 10,Address Compare Units 14 allows the data for the pixel associated with a particular stage to be operated on by Bit Processing Unit 61 in FIG. 6. The Address Compare Units 14 in FIG. 1 is composed of 1024 Address Compare Units shown as Address Compare Unit 90 in FIG. 9.

Figure 7:
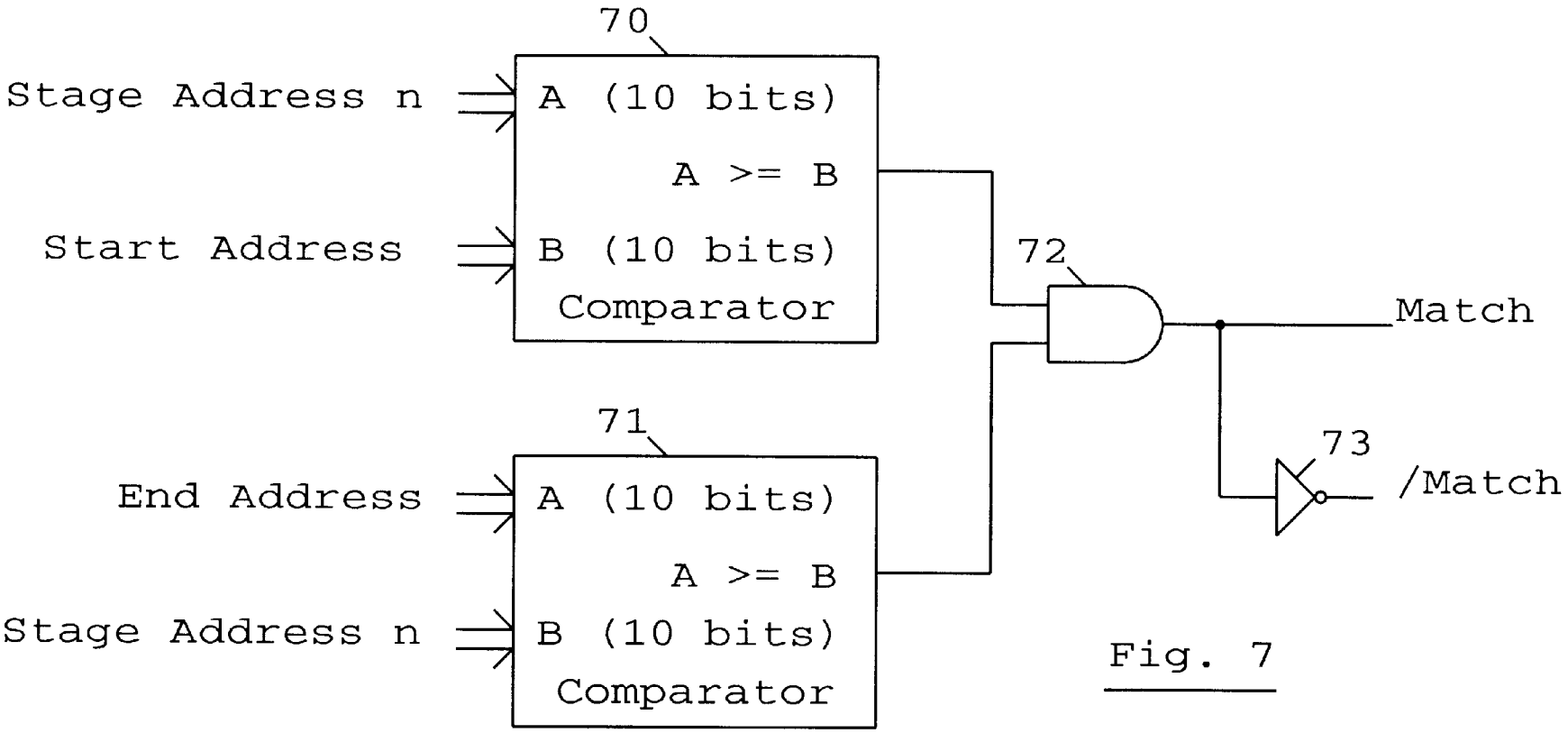
FIG. 7 is a block diagram of a Start_Address Comparator and End_Address Comparator for an Address Compare Unit of a single stage for a Row Addressable Graphics Memory With Flash Fill.

As previously described, FIG. 7 shows an Address Compare Unit for a "Row Addressable Graphics Memory With Flash Fill" without a Z-Buffer. When 'Stage Address n' is greater than or equal to 'Start Address' the output of Comparator 70 is asserted. When the 'End Address' is greater than or equal to 'Stage Address n' the output of Comparator 71 is asserted. When the outputs of both Comparator 70 and Comparator 71 are asserted, the output of AND Gate 72 is asserted, producing the 'Match' signal. It is the 'Match', signal along with its complement '/Match' (produced by Inverter 73) that tell Bit Processing Units(0–23) to process the bits for that particular stage.

Figure 8:
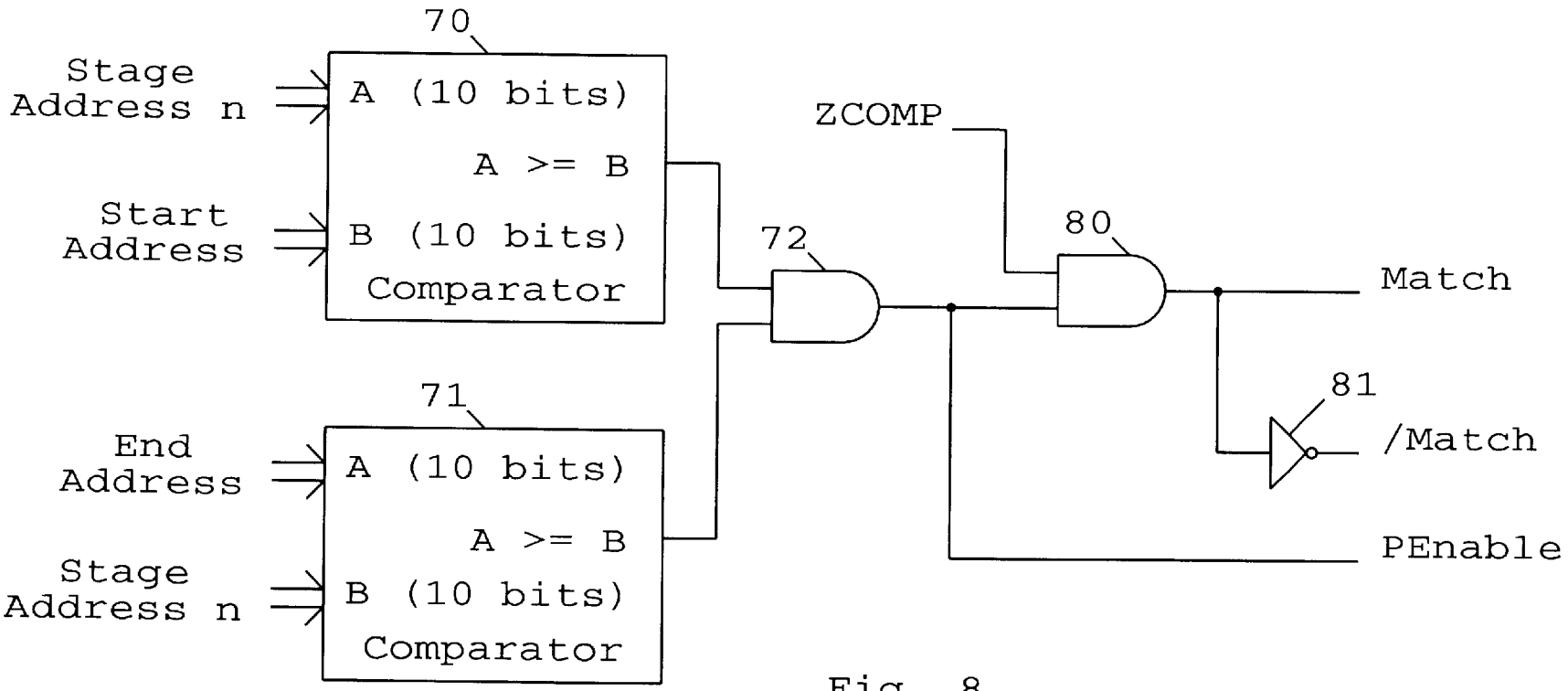
FIG. 8 shows the output of a Start_Address Comparator and End_Address Comparator for an Address Compare Unit of a single stage for a Row Addressable Graphics Memory With Flash Fill modified by Z-Buffer signals.

The addition of a Z-Buffer requires a change to the Address Compare Unit so that new pixels that are behind existing pixels do not get written to the pixel memory array. As compared with FIG. 7, FIG. 8 shows that when the output of AND Gate 72 is asserted, indicating that 'Stage Address n' is within the address range of 'Start Address' and 'End Address', that signal (renamed 'PEnable') is sent to Z Select Unit 13 in FIG. 1 to indicate that a Z replacement operation is a possibility. The Z Comparators 12 in FIG. 1 send their outputs to Address Compare Units 14 to indicate that the new pixel data for each particular stage is in front of the old pixel and therefore should replace it. This is accomplished by AND Gate 80 in FIG. 8. The 'Match' signal and its complement '/Match' generated by Inverter 81 tell Bit Processing Units(0–23) to process the bits for that particular stage. If the new pixel data is behind the old pixel data then the old pixel data is retained.

Figure 17:
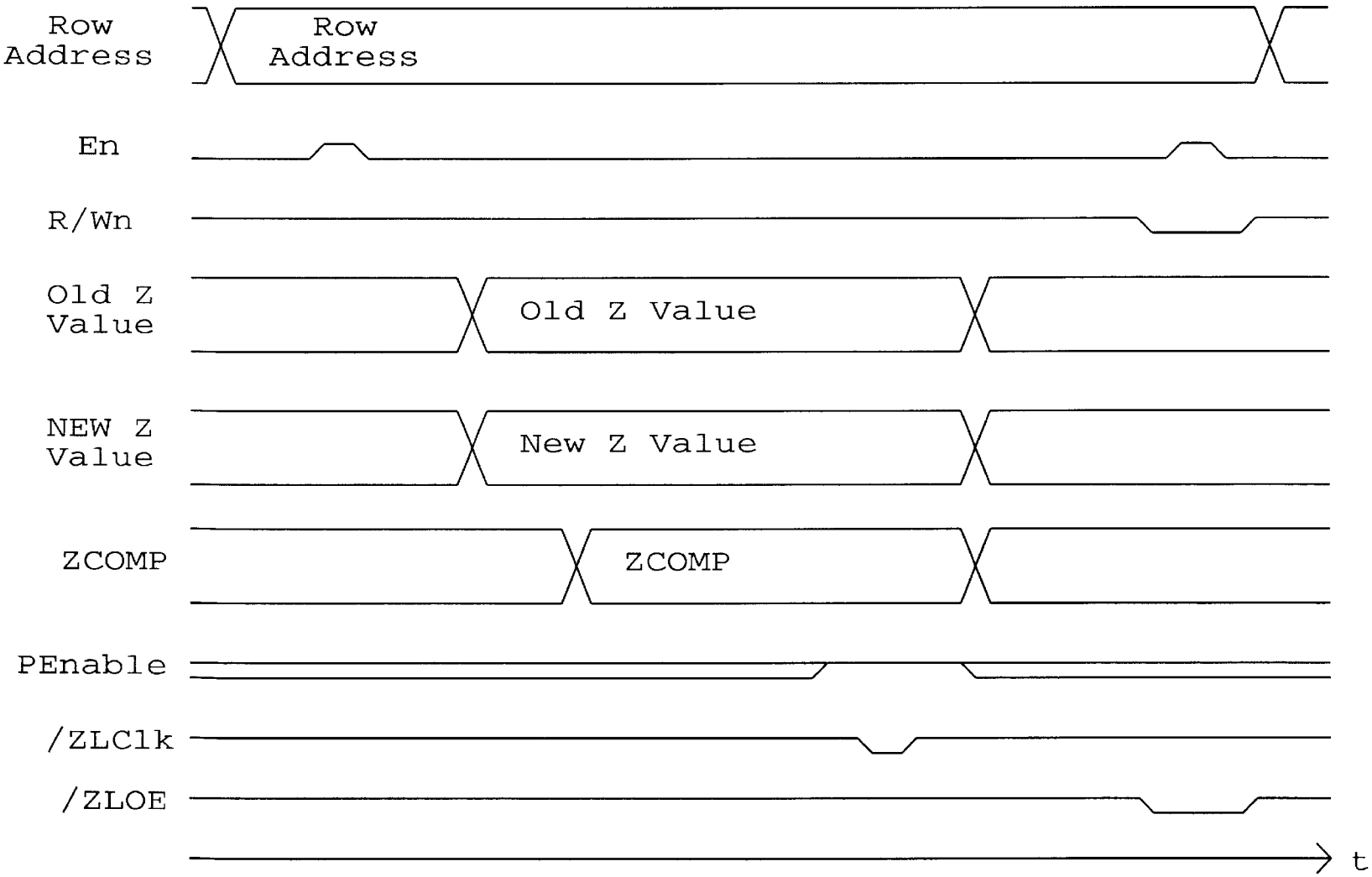
FIG. 17 is a timing diagram for a Z-Buffer operation in which a new Z value replaces an old Z value.
Figure 18:
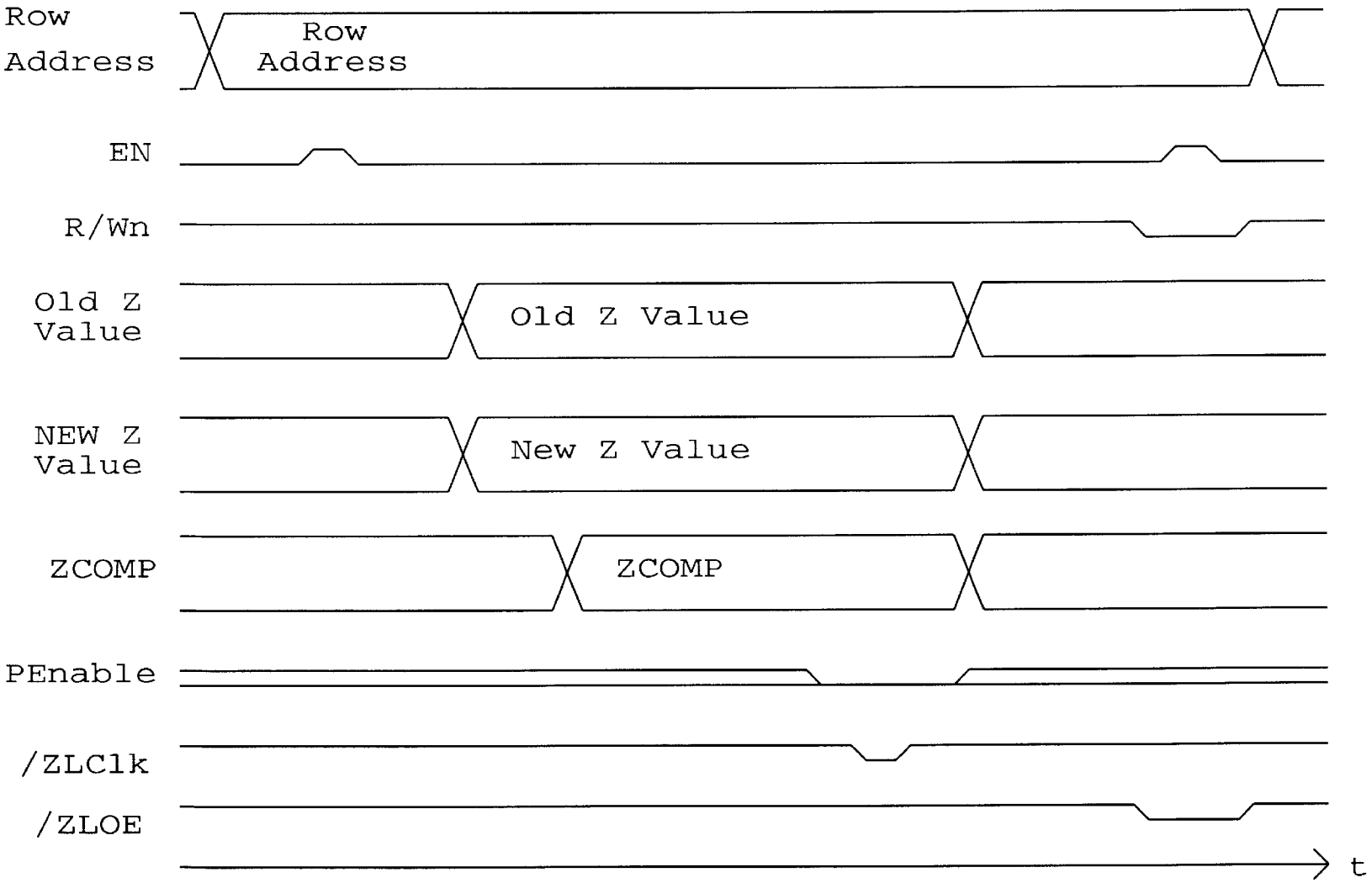
FIG. 18 is a timing diagram for a Z-Buffer operation in which a new Z value does not replace an old Z value.

Therefore, when the new pixel data is in front of the old pixel data the new pixel data will be used to update the pixel memory array (Memory Array 20) and the Z value of the new pixel will replace the old Z value of the old pixel in Z Memory Array 10. When the new pixel data is behind the old pixel data the old pixel data will be retained in the pixel memory array (Memory Array 20) and the Z value of the old pixel will likewise be retained in Z Memory Array 10. FIG. 17 is a timing diagram for a Z-Buffer operation in which a new Z value replaces an old Z value. FIG. 18 is a timing diagram for a Z-Buffer operation in which a new Z value does not replace an old Z value.

Figure 19:
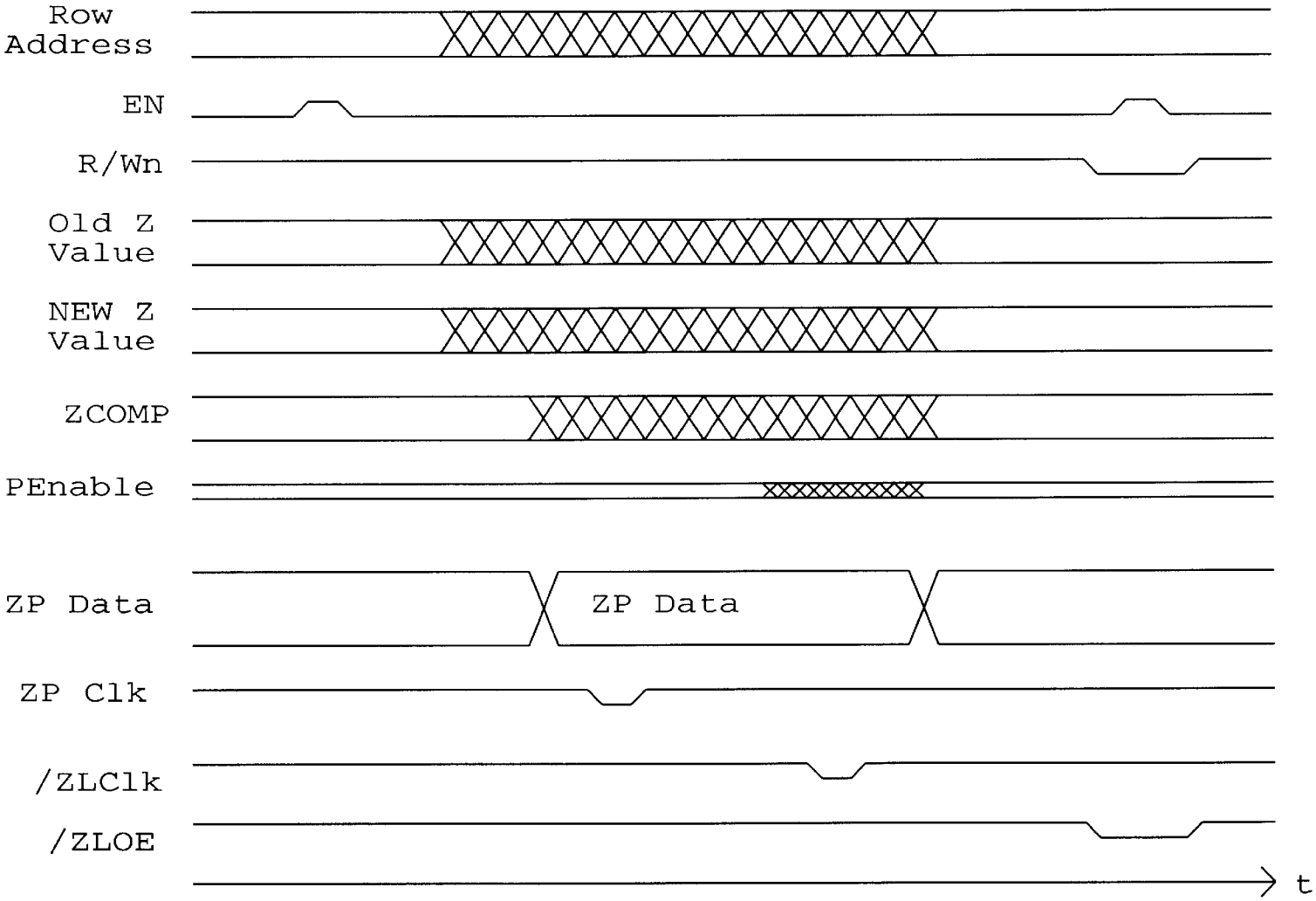
FIG. 19 is a timing diagram for a Z-Buffer operation in which both old and new Z values are ignored and the Z Preset Data is used.

As illustrated in FIGS. 1 and 4, when the 'Preset All Z' input to Z Select Unit 13 is asserted the data presented to Z Latch 16 will come from Z Preset Register 15. FIG. 19 is a timing diagram for a Z-Buffer operation in which both old and new Z values are ignored and the Z Preset Data is used.

Although Memory Array 20 may contain more than one screen of display memory, Z Memory Array 10 only needs to be large enough to cover one screen buffer. This is because after the Z-Buffer is used in allowing one pixel buffer to be filled, the Z-Buffer is no longer needed for that pixel buffer. Assuming a system with a Memory Array 20 large enough to contain two screens of memory (two Screen Buffers) the system operates as follows:

1. Initialize Screen Buffer 1 and the Z-Buffer;
2. Draw polygons into Screen Buffer 1 using the Z-Buffer;
3. Wait for Vertical Sync;
4. Switch the Screen Buffers to display Screen Buffer 1;
5. Initialize Screen Buffer 2 and the Z-Buffer;
6. Draw polygons into Screen Buffer 2 using the Z-Buffer;
7. Wait for Vertical Sync;
8. Switch the Screen Buffers to display Screen Buffer 2;
9. Go To Step 1.

Z-Buffer Math

Figure 10A:
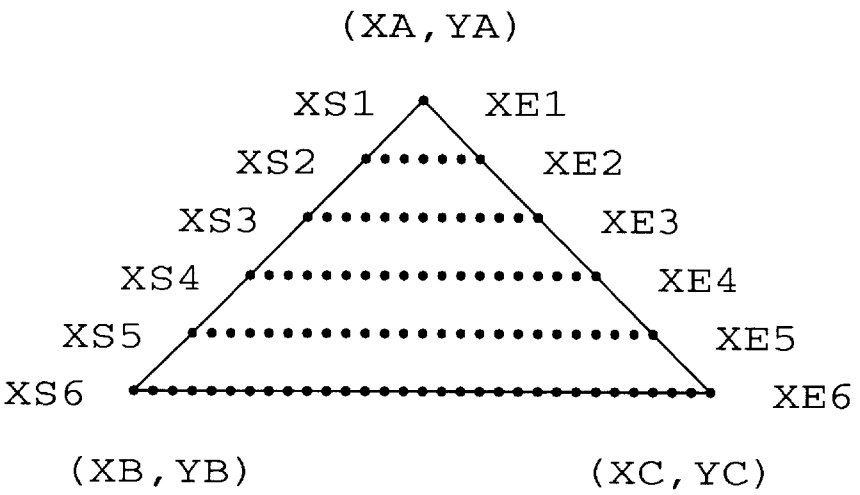
FIG. 10*a* shows the X_Start and X_End values for a polygon representing a two-dimensional shape.

Each polygon is composed of vertices. Referring to FIG. 10*a*, in a system without a Z-Buffer, each vertex has a screen X position and a screen Y position.

The top vertex is located and the slopes are calculated for the lines that connect to the top vertex.

These slopes are used to calculate the X_Start and X_End positions for each line segement as the Y coordinate is stepped down the screen.

Figure 10B:
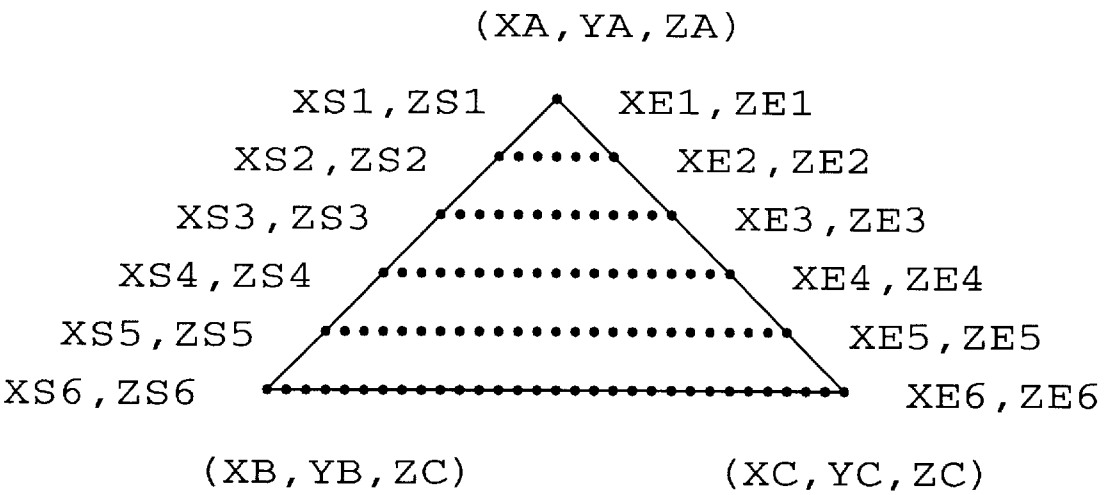
FIG. 10*b* shows the X_Start, Z_Start, X_End, and Z_End values for a polygon representing a three-dimensional shape.

As shown in FIG. 10*a* and FIG. 10*b*, X_Start will be abbreviated as 'XS' and X_End will be abbreviated as 'XE'.

Referring to FIG. 10*b*, in a system with a Z-Buffer, a depth value (usually called 'Z') is also associated with each vertex.

By interpolating the Z values from the vertices, the Z values at each X_Start and X_End position are determined.

Z_Start will be abbreviated as 'ZS' and Z_End will be abbreviated as 'ZE'.

Note that for a polygon that is parallel to the screen, all pixels have the same Zm values. Otherwise the Z value for each pixel may be different.

The traditional technique is to calculate the Z value for each pixel sequentially.

We start by calculating the Z slope for each line segment.

Each line segment m starts at XSm,Ym and ends at XEm,Ym.

The Z value at (XSm,Ym) is ZSm {Z_Start_m}. The Z value at {XEm,Ym} is ZEm {Z_End_m}.

The number of pixels from ZSm to ZEm is N=XEm−XSm

Therefore ZSm must change to ZEm over a distance of N pixels. Thus, the change in Z for each pixel {dz} is (ZEm−ZSm)/(XEm−Sm).

The Z value for each pixel can be calculated by using multiplication.

For each pixel n, as n goes from 0 (at XSm) to N (at XEm), Z=ZSm+n*dz.

Starting with Z=ZSm, Zn=Z(n−1)+dz for each pixel until n=N, where ZN will have added up to ZEm.

Therefore, for each line segment m:

$$Zn=ZSm+n*dz$$

where $$dz=(ZEm-ZSm)/(XEm-XSm).$$

There are several methods by which we can operate on all the pixels in a line segment simulaneously, but first we will redefine 'n'. Instead of n being offset from XSm, it will mean the stage position in an entire row of 1024 pixels.

Therefore each Z value in a line segment going from XSm to XEm will be:

$$Zn=ZSm+(n-XSm)*dz$$

As a check, when stage n=XSm:

```
Zn  = ZSm + (n-XSm) * dz
    = ZSm + (XSm-XSm) * dz
    = ZSm
```

When n=XEm:

```
Zn  = ZSm + (n-XSm) * dz
    = ZSm + (XEm-XSm) * dz
    = ZSm + (XEm-XSm) * (ZEm-ZSm)/(XEm-XSm)
    = ZSm + (ZEm-ZSm)
    = ZEm
```

Method 1—All Multipliers

Figure 11:
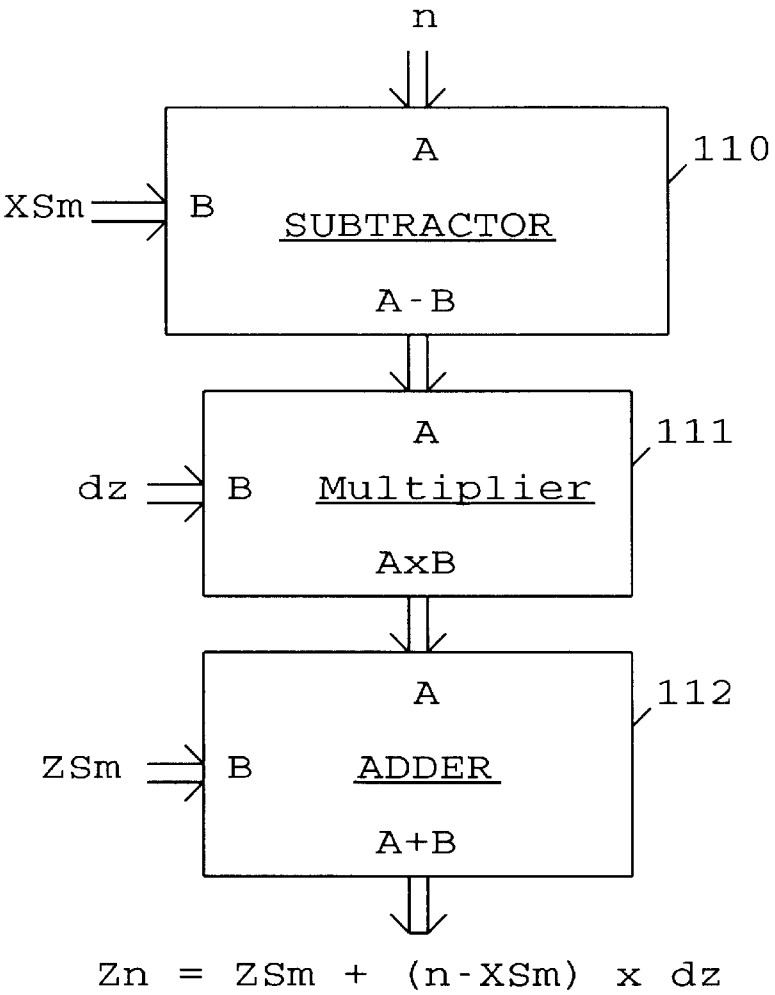
FIG. 11 is a block diagram of one embodiment of the invention showing a hardware implementation of the equation $Zn=ZSm+(n-ZSm)\times dz$.

In this method, each stage has associated with it an Adder 112, a Subtractor 110, and an Asynchronous Multiplier 111 as shown in FIG. 11. The general form for calculating the new Z values according to this method is shown in FIG. 12*a*. This method uses, for each stage, a Subtractor, a Multiplier, and an Adder to perform the equation:

$$Zn=ZSm+(n-ZSm)*dz,$$

where m is the number of the selected row, n is the number of the stage,

Zn is the Z value at the nth stage,

ZSm is the Z value at the start of the line segment for row m,

ZEm is the Z value at the end of the line segment for row m,

XSm is the X value at the start of the line segment for row m,

XEm is the X value at the end of the line segment for row m, $$dz=(ZEm-ZSm)/(XEm-XSm).$$

The propagation delay is equivalent to 12 adder delays.

| Transistor budget: | |
|---|---|
| Adders: 26 bits × 1024 × 100 transistors = | 2.6M |
| Subtractors: 26 bits × 1024 × 100 transistors = | 2.6M |
| Multipliers: 26 bits × 10 bits × 1024 × 100 transistors = | 26.6M |
| | 31.8M |

Figure 5:
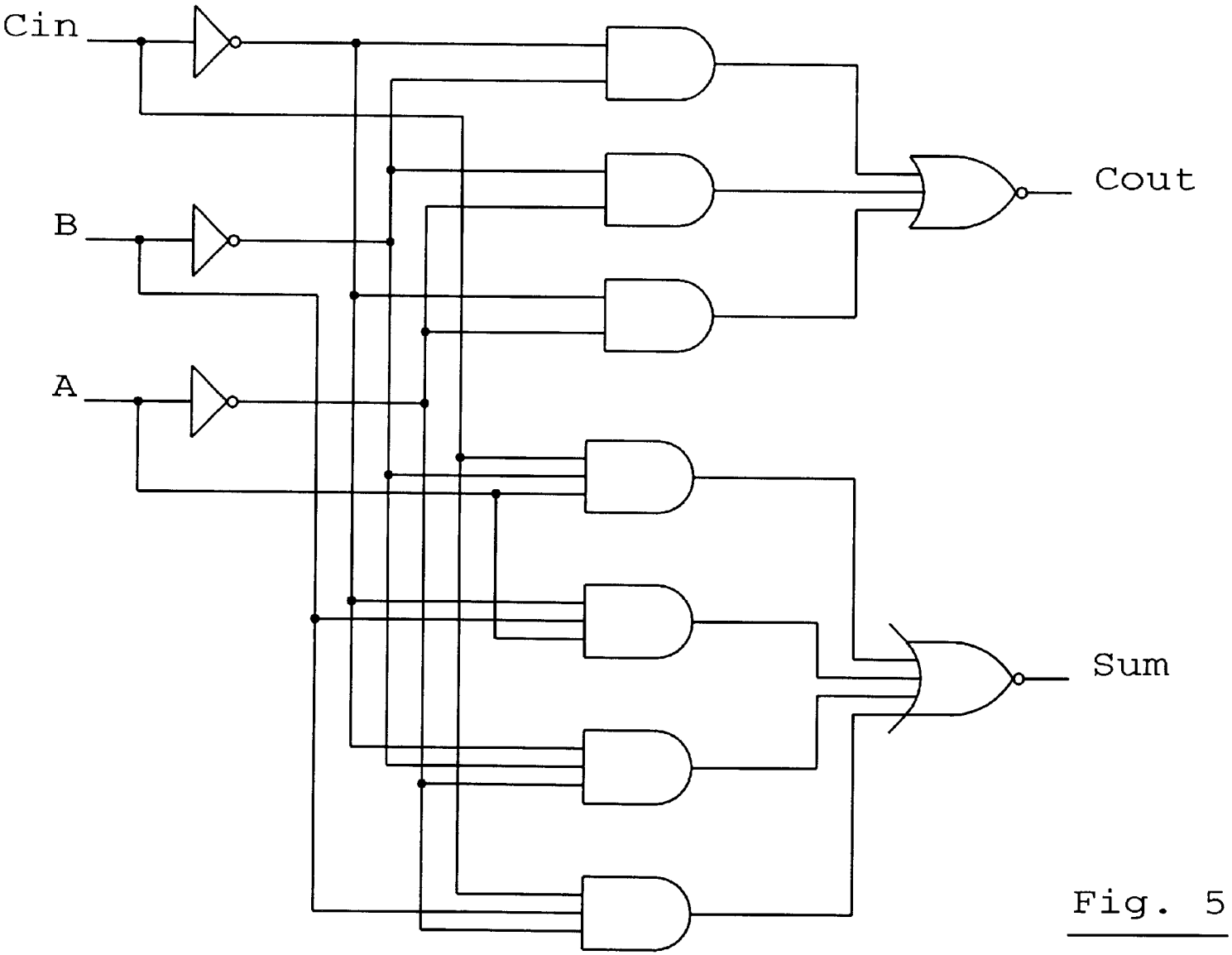
FIG. 5 is the logic circuit for a full 1-bit adder.

For the purpose of estimating transistor budgets, FIG. 5 is a logic diagram for a one-bit full adder and uses an estimated 100 transistors.

Method 2—Fewer Multipliers But More Delays

Instead of using a multiplier at each stage, we will use one on every kth stage and just add dz to the stages in between. The general form for calculating the new Z values using this method is shown in FIG. 12*b*. The tradeoff is that in return for reducing the number of multipliers we increase the maximum adder propagation delays. This method uses, for each kth stage, a Subtractor, a Multiplier, and an Adder to perform the equation:

$$Zn=ZSm+(n-ZSm)*dz,$$

where m is the number of the selected row, n is the number of the stage,

Zn is the Z value at the nth stage,

ZSm is the Z value at the start of the line segment for row m,

ZEm is the Z value at the end of the line segment for row m,

XSm is the X value at the start of the line segment for row m,

XEm is the X value at the end of the line segment for row m, $$dz=(ZEm-ZSm)/(XEm-XSm).$$

and every stage which is not a multiple of k uses an Adder which adds dz to the output of the previous stage.

| Transistor budget: | |
|---|---|
| Adders: 1024 stages × 26 bits × 100 transistors = | 2.6M |
| Subtractors: 256 stages × 26 bits × 100 transistors = | 2.6M |
| Multipliers: 256 stages × 26 bits × 10 bits × 100 transistors = | 6.6M |
| | 11.8M |

The maximum propagation delay is equivalent to 15 adder delays.

Method 3—All Adders

Having established that Zn=ZSm+(n−XSm)*dz, we will expand it to $$Zn=ZSm+n*dz-XSm*dz$$

For each line segment, ZSm as well as XSm*dz are constants and can be combined as: KZ=ZSm−XSm*dz Therefore, for each line segment m:

$$Zn=KZ+n*dz$$

for n=XSm to XEm (KZ only has to be calculated once for each line segment.)

As a check, when n=XSm, by definition Zn should be ZSm:

```
Zn  = KZ + n*dz
    = KZ + XSm*dz
    = ZSm − XSm*dz + XSm*dz
    = ZSm
```

and it is.

One method for calculating all Zn values simultaneously is:

1. Start with the register at stage 0 with Z0=KZ

2. To get the value at stage 1, use an adder with Z0 and dz as inputs.

3. Each successive stage n uses an adder to add dz to the value of stage n−1.

Unfortunately, stage 1023 will have gone through 1023 adders with 1023 adder propagation times.

The propagation delay can be made more reasonable by noticing that the propagation delay to stage 1023 can be halved by modifying stage 512 so that instead of adding dz to stage 511 it simply starts with KZ+512*dz. The value 512*dz can be obtained by connecting to the appropriate bits of the dz register. Stages 513 to 1023 would be connected as before, by adding dz to the previous stage.

We can reduce the propagation delay through the adders again:

1. Stage 256 starts at KZ+256*dz
2. Stage 512 starts at KZ+512*dz
3. Stage 768 starts at KZ+768*dz The values 256*dz and 512*dz are obtained by connecting to the appropriate bits of the dz register. 768*dz is obtained by adding (256*dz+512*dz) . If this process is taken to the limit we end up the multiplication method. However, if the stage number is used as the multiplier operand, the adders in the asynchronous multiplier can be eliminated wherever there are '0's in the stage number. This method uses, for each kth stage, a Subtractor and an Adder to perform the equation $$Zn=KZ+Wn,$$

where m is the number of the selected row, n is the number of the stage,

Zn is the Z value at the nth stage,

ZSm is the Z value at the start of the line segment for row m,

ZEm is the Z value at the end of the line segment for row m,

XSm is the X value at the start of the line segment for row m,

XEm is the X value at the end of the line segment for row m, $$KZ=ZSm-XSm*dz,$$

$$dz=(ZEm-ZSm)/(XEm-XSm),$$

$$Wn=w0*1*dz+w1*2*dz+w2*4*dz+w3*8*dz+\ldots+wj*bj*dz$$

where bj is a binary power of 2 (1,2,4,8,16,32, . . . ), wj is either 0 or 1, such that $$w0*1+w1*2+w2*4+w3*8+\ldots+wj*bj=n,$$

and every stage which is not a multiple of k uses an Adder which adds dz to the output of the previous stage.

The following is an example of the first thirty-two Z value calculations where the granularity (k, the number in each group) is 4.

| | |
|---|---|
| zn0 = KZ | zn16 = KZ + 16dz |
| zn1 = zn0 + dz | zn17 = zn16 + dz |
| zn2 = zn1 + dz | zn18 = zn17 + dz |
| zn3 = zn2 + dz | zn19 = zn18 + dz |
| zn4 = KZ + 4dz | zn20 = KZ + 16dz + 4dz |
| zn5 = zn4 + dz | zn21 = zn20 + dz |
| zn6 = zn5 + dz | zn22 = zn21 + dz |
| zn7 = zn6 + dz | zn23 = zn22 + dz |
| zn8 = KZ + 8dz | zn24 = KZ + 16dz + 8dz |
| zn9 = zn8 + dz | zn25 = zn24 + dz |
| zn10 = zn9 + dz | zn26 = zn25 + dz |
| zn11 = zn10 + dz | zn27 = zn26 + dz |
| zn12 = KZ + 8dz + 4dz | zn28 = KZ + 16dz + 8dz + 4dz |
| zn13 = zn12 + dz | zn29 = zn28 + dz |
| zn14 = zn13 + dz | zn30 = zn29 + dz |
| zn15 = zn14 + dz | zn31 = zn30 + dz |

Note that zn28=KZ+16dz+8dz+4dz can also be calculated as zn28=KZ+32dz−4dz to save one adder. There are other stages where subtraction can be used to reduce the number of adders.

Table 3 shows the first and last 32 stages for a granularity of 4.

Table 1 shows the first and last 32 stages for a granularity of 1 which is equivalent to using an asynchonous multiplier with the stage number used as the multiplier operand so that adders can be eliminated wherever there are '0's in the stage number.

Table 2 shows the first and last 32 stages for a granularity of 2. Note that the maximum number of adder propagation delays are the same as for a granularity of 1 even though it uses fewer adders.

Table 4 shows the first and last 32 stages for a granularity of 8.

Table 5 shows the first and last 32 stages for a granularity of 16.

The preferred embodiment will use a granularity of 4 as shown in Table 3.

Summary of Results for Method 3:

| | Granularity | Total Number of Adders | Maximum Number of Adder Propagation Delays |
|---|---|---|---|
| Table 1 | 1 | 5120 | 10 |
| Table 2 | 2 | 2816 | 10 |
| Table 3 | 4 | 1792 | 11 |
| Table 4 | 8 | 1344 | 14 |
| Table 5 | 16 | 1152 | 21 |

Transistor budget for Method 3 with a granularity of 4:

Adders: 1792 adders×40 bits×100 transistors =7,168,000

The maximum propagation delay is equivalent to 11 adder delays.

Method 2 (granularity 4) uses 11.8M transistors and has a maximum of 15 equivalent adder delays.

Method 3 (granularity 4) uses 7.2M transistors and has a maximum of 11 equivalent adder delays.

Although Method 2 (granularity 4) uses more transistors and has more maximum equivalent adder delays than Method 3 (granularity 4) there may be instances where Method 2 is a better choice since the structure for each group of 4 is more regular and therefore easier to reduce to silicon. Nonetheless, the preferred embodiment for the invention is Method 3 (granularity 4).

Since the new Z values are calculated for all 1024 stages even for short line segments, in one embodiment the bit length of the Z value calculations is extended. The dz register is extended by adding a 10 bit fraction and 10 most significant bits. This is because there are 1024 columns (10 bits=1024). KZ is also extended by adding a 10 bit fraction. However, there are 14 most significant bits added to allow for bit growth. This explains why the transistor budget calculations are for adders that are 40 bits wide.

Figure 13A:
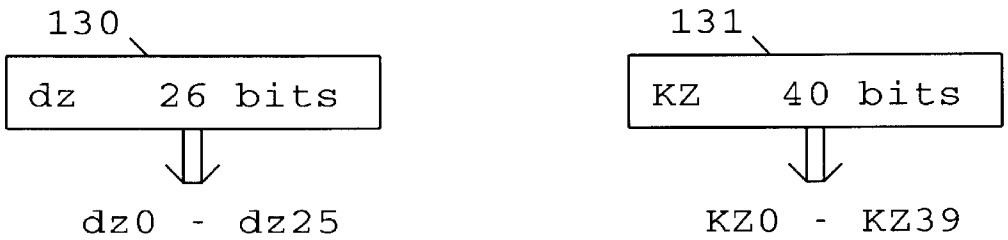
FIG. 13*a* shows the dz register and the KZ register for one embodiment of the invention.

FIG. 13*a* shows the dz Register 130 and KZ Register 131.

Figure 13B:
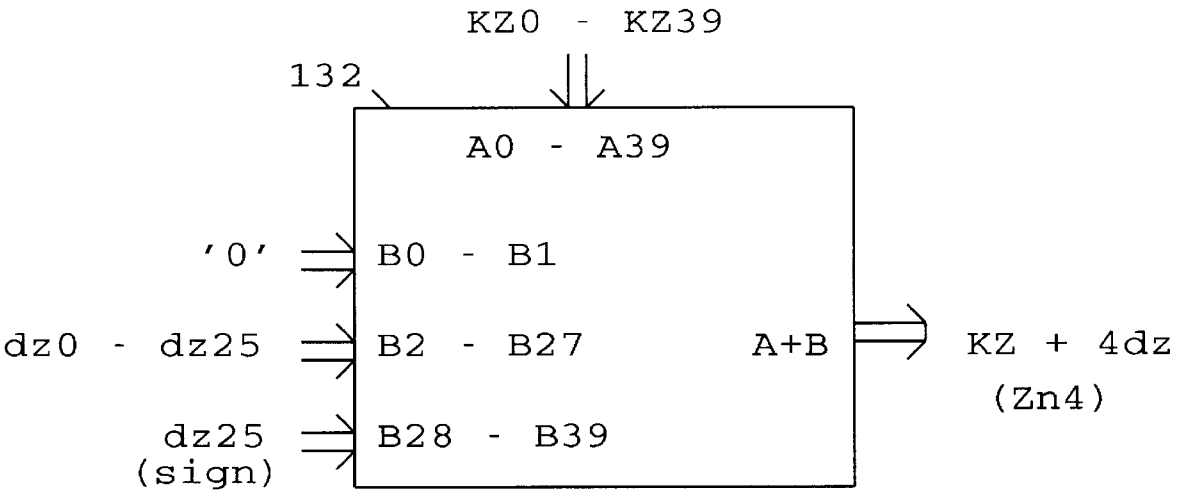
FIG. 13*b* shows the formation of the signal (KZ+4dz) for one embodiment of the invention.

FIG. 13*b* shows, as an example, the formation of the signal (KZ+4dz). By setting the two Least Significant Bits (LSBs) of the 'B' input to Adder 132 to '0' and by starting dz with the B2 input, dz is thereby multiplied by four.

Figure 14A:
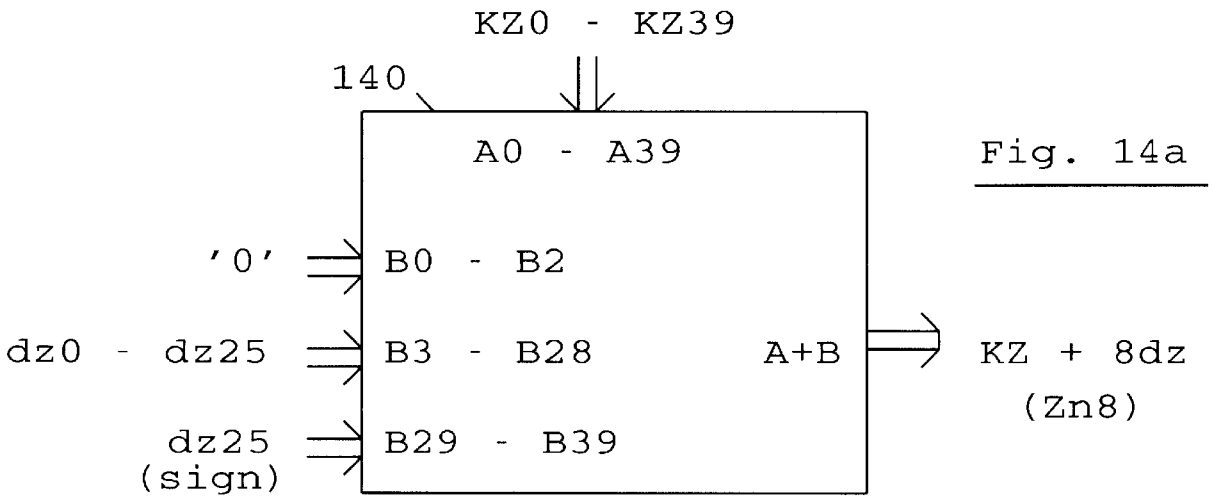
FIG. 14*a* shows the formation of the signal (KZ+8dz) for one embodiment of the invention.

FIG. 14*a* shows the formation of the signal (KZ+8dz). By setting the three LSBs of the 'B' input to Adder 140 to '0' and by starting dz with the B3 input, dz is thereby multiplied by eight.

Figure 14B:
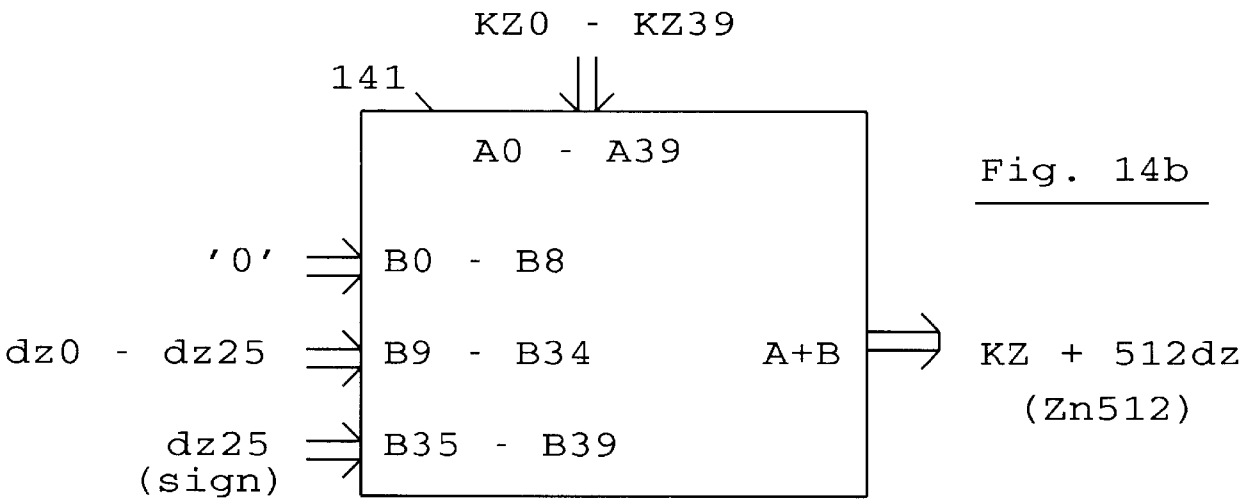
FIG. 14*b* shows the formation of the signal (KZ+512dz) for one embodiment of the invention.

FIG. 14*b* shows the formation of the signal (KZ+512dz). By setting the nine LSBs of the 'B' input to Adder 141 to '0' and by starting dz with the B9 input, dz is thereby multiplied by 512.

Figure 15A:
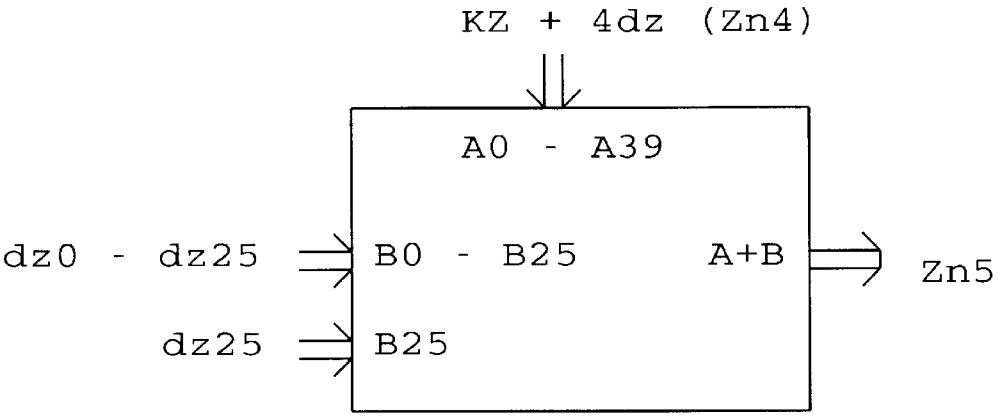
FIG. 15*a* shows the formation of the signal Zn5 for one embodiment of the invention.
Figure 15B:
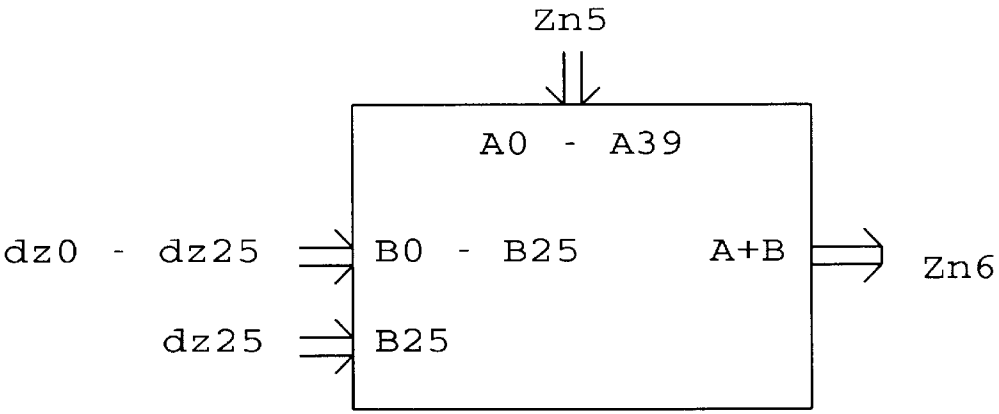
FIG. 15*b* shows the formation of the signal Zn6 for one embodiment of the invention.
Figure 16A:
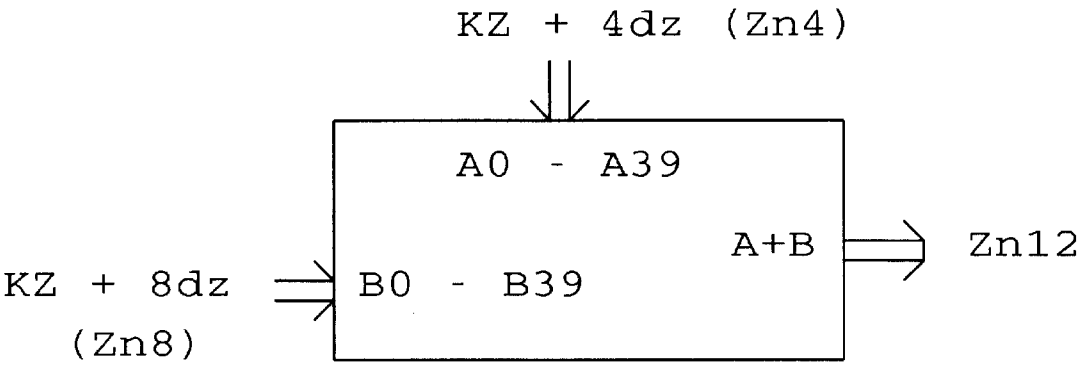
FIG. 16*a* shows the formation of the signal Zn12 for one embodiment of the invention.
Figure 16B:
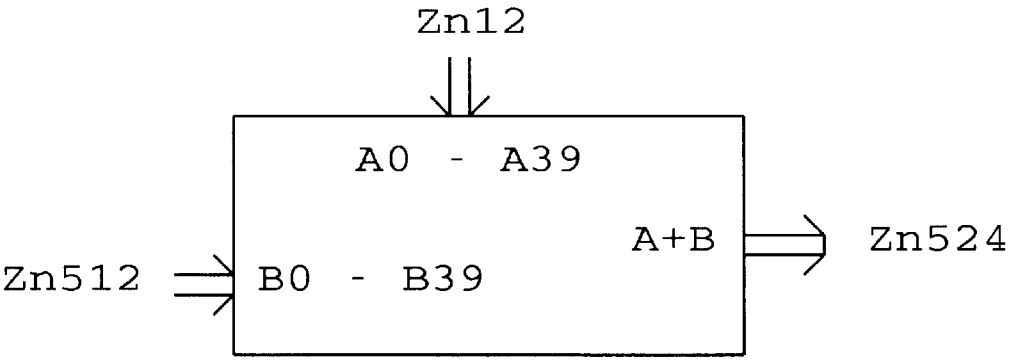
FIG. 16*b* shows the formation of the signal Zn524 for one embodiment of the invention.

Signals that are not binary multiples are formed by adding combinations of binary multiples to arrive at the desired results. By way of example, FIG. 15*a* shows the formation of the signal Zn5, FIG. 15*b* shows the formation of the signal Zn6, FIG. 16*a* shows the formation of the signal Zn12, and FIG. 16*b* shows the formation of the signal Zn524.

| Final Transistor Budget: | |
|---|---|
| Flash Fill Video Memory | 40,731,222 transistors |
| (2 buffers of 1024 x × 768 × 24 bits) | |
| Z Memory Array 10 | 12,582,912 transistors |
| (1024 × 768 × 16 bits) | |
| Z Comparators 12 | 1,638,400 transistors |
| (1024 × 16 × 100 transistors) | |
| NEW Z Values 11 | 7,168,000 transistors |
| (Method 3 with a granularity of 4) | |
| Z Select Unit 13 | 1,638,400 transistors |
| (1024 stages × 16 bits × 100 transistors) | |

-continued

| Final Transistor Budget: | |
|---|---|
| Z Latch 16 | 98,304 transistors |
| (1024 stages × 16 bits × 6 transistors) | |
| Total: | 63,857,238 transistors |

Sixty Four Million transistors are well within the range used by the 256 Megabit Dynamic RAMs announced by IBM on Jun. 6, 1995. ("IBM, Siemens, and Toshiba alliance announces smallest fully-functional 256 Mb DRAM chip.")

TABLE 1

(First and Last 32 Stages)

zn0 = KZ
zn1 = KZ + 1dz
zn2 = KZ + 2dz
zn3 = KZ + 2dz + 1dz
zn4 = KZ + 4dz
zn5 = KZ + 4dz + 1dz
zn6 = KZ + 4dz + 2dz
zn7 = KZ + 4dz + 2dz + 1dz
zn8 = KZ + 8dz
zn9 = KZ + 8dz + 1dz
zn10 = KZ + 8dz + 2dz
zn11 = KZ + 8dz + 2dz + 1dz
zn12 = KZ + 8dz + 4dz
zn13 = KZ + 8dz + 4dz + 1dz
zn14 = KZ + 8dz + 4dz + 2dz
zn15 = KZ + 8dz + 4dz + 2dz + 1dz
zn16 = KZ + 16dz
zn17 = KZ + 16dz + 1dz
zn18 = KZ + 16dz + 2dz
zn19 = KZ + 16dz + 2dz + 1dz
zn20 = KZ + 16dz + 4dz
zn21 = KZ + 16dz + 4dz + 1dz
zn22 = KZ + 16dz + 4dz + 2dz
zn23 = KZ + 16dz + 4dz + 2dz + 1dz
zn24 = KZ + 16dz + 8dz
zn25 = KZ + 16dz + 8dz + 1dz
zn26 = KZ + 16dz + 8dz + 2dz
zn27 = KZ + 16dz + 8dz + 2dz + 1dz
zn28 = KZ + 16dz + 8dz + 4dz
zn29 = KZ + 16dz + 8dz + 4dz + 1dz
zn30 = KZ + 16dz + 8dz + 4dz + 2dz
zn31 = KZ + 16dz + 8dz + 4dz + 2dz + 1dz
.
.
.
.
zn992 = KZ + 512dz + 256dz + 128dz + 64dz + 32dz
zn993 = KZ + 512dz + 256dz + 128dz + 64dz + 32dz + 1dz
zn994 = KZ + 512dz + 256dz + 128dz + 64dz + 32dz + 2dz
zn995 = KZ + 512dz + 256dz + 128dz + 64dz + 32dz + 2dz + 1dz
zn996 = KZ + 512dz + 256dz + 128dz + 64dz + 32dz + 4dz
zn997 = KZ + 512dz + 256dz + 128dz + 64dz + 32dz + 4dz + 1dz
zn998 = KZ + 512dz + 256dz + 128dz + 64dz + 32dz + 4dz + 2dz
zn999 = KZ + 512dz + 256dz + 128dz + 64dz + 32dz + 4dz + 2dz + 1dz
zn1000 = KZ + 512dz + 256dz + 128dz + 64dz + 32dz + 8dz
zn1001 = KZ + 512dz + 256dz + 128dz + 64dz + 32dz + 8dz + 1dz
zn1002 = KZ + 512dz + 256dz + 128dz + 64dz + 32dz + 8dz + 2dz
zn1003 = KZ + 512dz + 256dz + 128dz + 64dz + 32dz + 8dz + 2dz + 1dz
zn1004 = KZ + 512dz + 256dz + 128dz + 64dz + 32dz + 8dz + 4dz
zn1005 = KZ + 512dz + 256dz + 128dz + 64dz + 32dz + 8dz + 4dz + 1dz
zn1006 = KZ + 512dz + 256dz + 128dz + 64dz + 32dz + 8dz + 4dz + 2dz
zn1007 = KZ + 512dz + 256dz + 128dz + 64dz + 32dz + 8dz + 4dz + 2dz + 1dz
zn1008 = KZ + 512dz + 256dz + 128dz + 64dz + 32dz + 16dz
zn1009 = KZ + 512dz + 256dz + 128dz + 64dz + 32dz + 16dz + 1dz
zn1010 = KZ + 512dz + 256dz + 128dz + 64dz + 32dz + 16dz + 2dz
zn1011 = KZ + 512dz + 256dz + 128dz + 64dz + 32dz + 16dz + 2dz + 1dz
zn1012 = KZ + 512dz + 256dz + 128dz + 64dz + 32dz + 16dz + 4dz
zn1013 = KZ + 512dz + 256dz + 128dz + 64dz + 32dz + 16dz + 4dz + 1dz

TABLE 1-continued (First and Last 32 Stages)

zn1014 = KZ + 512dz + 256dz + 128dz + 64dz + 32dz + 16dz + 4dz + 2dz
zn1015 = KZ + 512dz + 256dz + 128dz + 64dz + 32dz + 16dz + 4dz + 2dz + 1dz
zn1016 = KZ + 512dz + 256dz + 128dz + 64dz + 32dz + 16dz + 8dz
zn1017 = KZ + 512dz + 256dz + 128dz + 64dz + 32dz + 16dz + 8dz + 1dz
zn1018 = KZ + 512dz + 256dz + 128dz + 64dz + 32dz + 16dz + 8dz + 2dz
zn1019 = KZ + 512dz + 256dz + 128dz + 64dz + 32dz + 16dz + 8dz + 2dz + 1dz
zn1020 = KZ + 512dz + 256dz + 128dz + 64dz + 32dz + 16dz + 8dz + 4dz
zn1021 = KZ + 512dz + 256dz + 128dz + 64dz + 32dz + 16dz + 8dz + 4dz + 1dz
zn1022 = KZ + 512dz + 256dz + 128dz + 64dz + 32dz + 16dz + 8dz + 4dz + 2dz
zn1023 = KZ + 512dz + 256dz + 128dz + 64dz + 32dz + 16dz + 8dz + 4dz + 2dz + 1dz

TABLE 2

(First and Last 32 Stages)

zn0 = KZ
zn1 = zn0 + dz
zn2 = KZ + 2dz
zn3 = zn2 + dz
zn4 = KZ + 4dz
zn5 = zn4 + dz
zn6 = KZ + 4dz + 2dz
zn7 = zn6 + dz
zn8 = KZ + 8dz
zn9 = zn8 + dz
zn10 = KZ + 8dz + 2dz
zn11 = zn10 + dz
zn12 = KZ + 8dz + 4dz
zn13 = zn12 + dz
zn14 = KZ + 8dz + 4dz + 2dz
zn15 = zn14 + dz
zn16 = KZ + 16dz
zn17 = zn16 + dz
zn18 = KZ + 16dz + 2dz
zn19 = zn18 + dz
zn20 = KZ + 16dz + 4dz
zn21 = zn20 + dz
zn22 = KZ + 16dz + 4dz + 2dz
zn23 = zn22 + dz
zn24 = KZ + 16dz + 8dz
zn25 = zn24 + dz
zn26 = KZ + 16dz + 8dz + 2dz
zn27 = zn26 + dz
zn28 = KZ + 16dz + 8dz + 4dz
zn29 = zn28 + dz
zn30 = KZ + 16dz + 8dz + 4dz + 2dz
zn31 = zn30 + dz
.
.
zn992 = KZ + 512dz + 256dz + 128dz + 64dz + 32dz
zn993 = zn992 + dz
zn994 = KZ + 512dz + 256dz + 128dz + 64dz + 32dz + 2dz
zn995 = zn994 + dz
zn996 = KZ + 512dz + 256dz + 128dz + 64dz + 32dz + 4dz
zn997 = zn996 + dz
zn998 = KZ + 512dz + 256dz + 128dz + 64dz + 32dz + 4dz + 2dz
zn999 = zn998 + dz
zn1000 = KZ + 512dz + 256dz + 128dz + 64dz + 32dz + 8dz
zn1001 = zn1000 + dz
zn1002 = KZ + 512dz + 256dz + 128dz + 64dz + 32dz + 8dz + 2dz
zn1003 = zn1002 + dz
zn1004 = KZ + 512dz + 256dz + 128dz + 64dz + 32dz + 8dz + 4dz
zn1005 = zn1004 + dz
zn1006 = KZ + 512dz + 256dz + 128dz + 64dz + 32dz + 8dz + 4dz + 2dz
zn1007 = zn1006 + dz
zn1008 = KZ + 512dz + 256dz + 128dz + 64dz + 32dz + 16dz
zn1009 = zn1008 + dz
zn1010 = KZ + 512dz + 256dz + 128dz + 64dz + 32dz + 16dz + 2dz
zn1011 = zn1010 + dz
zn1012 = KZ + 512dz + 256dz + 128dz + 64dz + 32dz + 16dz + 4dz
zn1013 = zn1012 + dz
zn1014 = KZ + 512dz + 256dz + 128dz + 64dz + 32dz + 16dz + 4dz + 2dz

TABLE 2-continued (First and Last 32 Stages)

zn1015 = zn1014 + dz
zn1016 = KZ + 512dz + 256dz + 128dz + 64dz + 32dz + 16dz + 8dz
zn1017 = zn1016 + dz
zn1018 = KZ + 512dz + 256dz + 128dz + 64dz + 32dz + 16dz + 8dz + 2dz
zn1019 = zn1018 + dz
zn1020 = KZ + 512dz + 256dz + 128dz + 64dz + 32dz + 16dz + 8dz + 4dz
zn1021 = zn1020 + dz
zn1022 = KZ + 512dz + 256dz + 128dz + 64dz + 32dz + 16dz + 8dz + 4dz + 2dz
zn1023 = zn1022 + dz

TABLE 3

(First and Last 32 Stages)

zn0 = KZ
zn1 = zn0 + dz
zn2 = zn1 + dz
zn3 = zn2 + dz
zn4 = KZ + 4dz
zn5 = zn4 + dz
zn6 = zn5 + dz
zn7 = zn6 + dz
zn8 = KZ + 8dz
zn9 = zn8 + dz
zn10 = zn9 + dz
zn11 = zn10 + dz
zn12 = KZ + 8dz + 4dz
zn13 = zn12 + dz
zn14 = zn13 + dz
zn15 = zn14 + dz
zn16 = KZ + 16dz
zn17 = zn16 + dz
zn18 = zn17 + dz
zn19 = zn18 + dz
zn20 = KZ + 16dz + 4dz
zn21 = zn20 + dz
zn22 = zn21 + dz
zn23 = zn22 + dz
zn24 = KZ + 16dz + 8dz
zn25 = zn24 + dz
zn26 = zn25 + dz
zn27 = zn26 + dz
zn28 = KZ + 16dz + 8dz + 4dz
zn29 = zn28 + dz
zn30 = zn29 + dz
zn31 = zn30 + dz
.
.
.
.
zn992 = KZ + 512dz + 256dz + 128dz + 64dz + 32dz
zn993 = zn992 + dz
zn994 = zn993 + dz

TABLE 3-continued (First and Last 32 Stages)

zn995 = zn994 + dz
zn996 = KZ + 512dz + 256dz + 128dz + 64dz + 32dz + 4dz
zn997 = zn996 + dz
zn998 = zn997 + dz
zn999 = zn998 + dz
zn1000 = KZ + 512dz + 256dz + 128dz + 64dz + 32dz + 8dz
zn1001 = zn1000 + dz
zn1002 = zn1001 + dz
zn1003 = zn1002 + dz
zn1004 = KZ + 512dz + 256dz + 128dz + 64dz + 32dz + 8dz + 4dz
zn1005 = zn1004 + dz
zn1006 = zn1005 + dz
zn1007 = zn1006 + dz
zn1008 = KZ + 512dz + 256dz + 128dz + 64dz + 32dz + 16dz
zn1009 = zn1008 + dz
zn1010 = zn1009 + dz
zn1011 = zn1010 + dz
zn1012 = KZ + 512dz + 256dz + 128dz + 64dz + 32dz + 16dz + 4dz
zn1013 = zn1012 + dz
zn1014 = zn1013 + dz
zn1015 = zn1014 + dz
zn1016 = KZ + 512dz + 256dz + 128dz + 64dz + 32dz + 16dz + 8dz
zn1017 = zn1016 + dz
zn1018 = zn1017 + dz
zn1019 = zn1018 + dz
zn1020 = KZ + 512dz + 256dz + 128dz + 64dz + 32dz + 16dz + 8dz + 4dz
zn1021 = zn1020 + dz
zn1022 = zn1021 + dz
zn1023 = zn1022 + dz

TABLE 4

(First and Last 32 Stages)

zn0 = KZ
zn1 = zn0 + dz
zn2 = zn1 + dz
zn3 = zn2 + dz
zn4 = zn3 + dz
zn5 = zn4 + dz
zn6 = zn5 + dz
zn7 = zn6 + dz
zn8 = KZ + 8dz
zn9 = zn8 + dz
zn10 = zn9 + dz
zn11 = zn10 + dz
zn12 = zn11 + dz
zn13 = zn12 + dz
zn14 = zn13 + dz
zn15 = zn14 + dz
zn16 = KZ + 16dz
zn17 = zn16 + dz
zn18 = zn17 + dz
zn19 = zn18 + dz
zn20 = zn19 + dz
zn21 = zn20 + dz
zn22 = zn21 + dz
zn23 = zn22 + dz
zn24 = KZ + 16dz + 8dz
zn25 = zn24 + dz
zn26 = zn25 + dz
zn27 = zn26 + dz
zn28 = zn27 + dz
zn29 = zn28 + dz
zn30 = zn29 + dz
zn31 = zn30 + dz
.
.
.
.
zn992 = KZ + 512dz + 256dz + 128dz + 64dz + 32dz
zn993 = zn992 + dz
zn994 = zn993 + dz

TABLE 4-continued (First and Last 32 Stages)

zn995 = zn994 + dz
zn996 = zn995 + dz
zn997 = zn996 + dz
zn998 = zn997 + dz
zn999 = zn998 + dz
zn1000 = KZ + 512dz + 256dz + 128dz + 64dz + 32dz + 8dz
zn1001 = zn1000 + dz
zn1002 = zn1001 + dz
zn1003 = zn1002 + dz
zn1004 = zn1003 + dz
zn1005 = zn1004 + dz
zn1006 = zn1005 + dz
zn1007 = zn1006 + dz
zn1008 = KZ + 512dz + 256dz + 128dz + 64dz + 32dz + 16dz
zn1009 = zn1008 + dz
zn1010 = zn1009 + dz
zn1011 = zn1010 + dz
zn1012 = zn1011 + dz
zn1013 = zn1012 + dz
zn1014 = zn1013 + dz
zn1015 = zn1014 + dz
zn1016 = KZ + 512dz + 256dz + 128dz + 64dz + 32dz + 16dz + 8dz
zn1017 = zn1016 + dz
zn1018 = zn1017 + dz
zn1019 = zn1018 + dz
zn1020 = zn1019 + dz
zn1021 = zn1020 + dz
zn1022 = zn1021 + dz
zn1023 = zn1022 + dz

TABLE 5

(First and Last 32 Stages)

zn0 = KZ
zn1 = zn0 + dz
zn2 = zn1 + dz
zn3 = zn2 + dz
zn4 = zn3 + dz
zn5 = zn4 + dz
zn6 = zn5 + dz
zn7 = zn6 + dz
zn8 = zn7 + dz
zn9 = zn8 + dz
zn10 = zn9 + dz
zn11 = zn10 + dz
zn12 = zn11 + dz
zn13 = zn12 + dz
zn14 = zn13 + dz
zn15 = zn14 + dz
zn16 = KZ + 16dz
zn17 = zn16 + dz
zn18 = zn17 + dz
zn19 = zn18 + dz
zn20 = zn19 + dz
zn21 = zn20 + dz
zn22 = zn21 + dz
zn23 = zn22 + dz
zn24 = zn23 + dz
zn25 = zn24 + dz
zn26 = zn25 + dz
zn27 = zn26 + dz
zn28 = zn27 + dz
zn29 = zn28 + dz
zn30 = zn29 + dz
zn31 = zn30 + dz
.
.
.
.
zn992 = KZ + 512dz + 256dz + 128dz + 64dz + 32dz
zn993 = zn992 + dz
zn994 = zn993 + dz
zn995 = zn994 + dz

TABLE 5-continued (First and Last 32 Stages)

| |
|---|
| zn996 = zn995 + dz |
| zn997 = zn996 + dz |
| zn998 = zn997 + dz |
| zn999 = zn998 + dz |
| zn1000 = zn999 + dz |
| zn1001 = zn1000 + dz |
| zn1002 = zn1001 + dz |
| zn1003 = zn1002 + dz |
| zn1004 = zn1003 + dz |
| zn1005 = zn1004 + dz |
| zn1006 = zn1005 + dz |
| zn1007 = zn1006 + dz |
| zn1008 = KZ + 512dz + 256dz + 128dz + 64dz + 32dz + 16dz |
| zn1009 = zn1008 + dz |
| zn1010 = zn1009 + dz |
| zn1011 = zn1010 + dz |
| zn1012 = zn1011 + dz |
| zn1013 = zn1012 + dz |
| zn1014 = zn1013 + dz |
| zn1015 = zn1014 + dz |
| zn1016 = zn1015 + dz |
| zn1017 = zn1016 + dz |
| zn1018 = zn1017 + dz |
| zn1019 = zn1018 + dz |
| zn1020 = zn1019 + dz |
| zn1021 = zn1020 + dz |
| zn1022 = zn1021 + dz |
| zn1023 = zn1022 + dz |

While the invention has been described in terms of several embodiments, those skilled in the art will recognize that the invention is not limited to the embodiments described. The method and apparatus of the invention can be practiced with modification and alteration within the spirit and scope of the appended claims. The description is thus to be regarded as illustrative instead of limiting on the invention.

I claim:

1. A Z-Buffer for a Row Addressable Graphics Memory with Flash Fill comprising:

(a) a row addressable Z Memory Array for storing a plurality of rows of a plurality of Z values, wherein each Z value is associated with a pixel stored in said Row Addressable Graphics Memory;

(b) a New Z Values unit having inputs for at least a first Z value data for a start address for a line segment and a second Z value data for an end address for said line segment, and comprising a plurality of units for calculating a new Z value for each stage in a selected row, wherein each said new Z value in said New Z Values unit is calculated substantially simultaneously, and wherein said New Z Values unit comprises for each stage a Subtractor, a Multiplier, and an Adder to perform the equation Zn=ZSm+(n−ZSm)*dz, wherein
m is the number of said selected row,
n is the number of said stage,
Zn is the Z value at the nth stage,
ZSm is the Z value at the start of said line segment for row m,
ZEm is the Z value at the end of said line segment for said row m,
XSm is the X value at the start of said line segment for said row m,
XEm is the X value at the end of said line segment for said row m, $$dz=(ZEm-ZSm)/(XEm-XSm);$$

(c) a plurality of Z Comparators for comparing each said Z value from said each stage in said selected row of said Z Memory Array with each associated said new Z value from said New Z Values unit, wherein said plurality of Z Comparators operate simultaneously;

(d) a Z Preset Register for storing a preset value for presetting said Z values in said Z Memory Array;

(e) an Address Compare Unit having inputs for said start address and said end address of said line segment to be drawn for determining for said each stage whether said stage is within the range of said start address and said end address and further determining whether each said new Z value is to replace each associated old Z value from said Z Memory Array and whether data representing a new pixel is to replace data representing an old pixel;

(f) a Z Select Unit for selecting for each of its outputs one of the following according to the output of each of the corresponding said Z Comparators, said Address Compare Unit, and also according to a control input signal:
(i) said old Z value from said Z Memory Array;
(ii) said new Z value from said New Z Values unit;
(iii) said preset value from said Z Preset Register;

(g) a Latch means for storing the data output from said Z Select Unit, wherein said data output from said Z Select Unit is to be written into said Z Memory Array.

2. A Z-Buffer for a Row Addressable Graphics Memory with Flash Fill comprising:

(a) a row addressable Z Memory Array for storing a plurality of rows of a plurality of Z values, wherein each Z value is associated with a pixel stored in said Row Addressable Graphics Memory;

(b) a New Z Values unit having inputs for at least a first Z value data for a start address for a line segment and a second Z value data for an end address for said line segment, and comprising a plurality of units for calculating a new Z value for each stage in a selected row, wherein each said new Z value in said New Z Values unit is calculated substantially simultaneously, and wherein said New Z Values unit comprises for each kth stage a Subtractor, a Multiplier, and an Adder to perform the equation Zn=ZSm+(n−ZSm)*dz, wherein
m is the number of said selected row,
n is the number of said stage,
Zn is the Z value at the nth stage,
ZSm is the Z value at the start of said line segment for row m,
ZEm is the Z value at the end of said line segment for said row m,
XSm is the X value at the start of said line segment for said row m,
XEm is the X value at the end of said line segment for said row m, $$dz=(ZEm-ZSm)/(XEm-XSm),$$

and further comprises for every said stage which is not a multiple of k an Adder for adding dz to the output of the previous stage;

(c) a plurality of Z Comparators for comparing each said Z value from said each stage in said selected row of said Z Memory Array with each associated said new Z value from said New Z Values unit, wherein said plurality of Z Comparators operate simultaneously;

(d) a Z Preset Register for storing a preset value for presetting said Z values in said Z Memory Array;

(e) an Address Compare Unit having inputs for said start address and said end address of said line segment to be drawn for determining for said each stage whether said stage is within the range of said start address and said end address and further determining whether each said new Z value is to replace each associated old Z value from said Z Memory Array and whether data representing a new pixel is to replace data representing an old pixel;

(f) a Z Select Unit for selecting for each of its outputs one of the following according to the output of each of the corresponding said Z Comparators, said Address Compare Unit, and also according to a control input signal:
(i) said old Z value from said Z Memory Array;
(ii) said new Z value from said New Z Values unit;
(iii) said preset value from said Z Preset Register;

(g) a Latch means for storing the data output from said Z Select Unit, wherein said data output from said Z Select Unit is to be written into said Z Memory Array.

3. A Z-Buffer for a Row Addressable Graphics Memory with Flash Fill comprising:

(a) a row addressable Z Memory Array for storing a plurality of rows of a plurality of Z values, wherein each Z value is associated with a pixel stored in said Row Addressable Graphics Memory;

(b) a New Z Values unit having inputs for at least a first Z value data for a start address for a line segment and a second Z value data for an end address for said line segment, and comprising a plurality of units for calculating a new Z value for each stage in a selected row, wherein each said new Z value in said New Z Values unit is calculated substantially simultaneously, and wherein said New Z Values unit comprises for each kth stage a Subtractor and at least one Adder to perform the equation Zn=KZ+Wn, wherein
m is the number of said selected row,
n is the number of said stage,
Zn is the Z value at the nth stage,
ZSm is the Z value at the start of said line segment for row m,
ZEm is the Z value at the end of said line segment for said row m,
XSm is the X value at the start of said line segment for said row m,
XEm is the X value at the end of said line segment for said row m, $$KZ=ZSm-XSm*dz,$$

$$dz=(ZEm-ZSm)/(XEm-XSm),$$

$$Wn=w0*1*dz+w1*2*dz+w2*4+dz+w3+8*dz+\ldots+wj*bj*dz,$$

wherein
bj is a binary power of 2 (1,2,4,8,16,32, . . . ),
wj is either 0 or 1, such that $$w0*1+w1*2+w2*4+w3*8+\ldots+wj*bj=n,$$

and further comprises for every said stage which is not a multiple of k an Adder for adding dz to the output of the previous stage;

(c) a plurality of Z Comparators for comparing each said Z value from said each stage in said selected row of said Z Memory Array with each associated said new Z value from said New Z Values unit, wherein said plurality of Z Comparators operate simultaneously;

(d) a Z Preset Register for storing a preset value for presetting said Z values in said Z Memory Array;

(e) an Address Compare Unit having inputs for said start address and said end address of said line segment to be drawn for determining for said each stage whether said stage is within the range of said start address and said end address and further determining whether each said new Z value is to replace each associated old Z value from said Z Memory Array and whether data representing a new pixel is to replace data representing an old pixel;

(f) a Z Select Unit for selecting for each of its outputs one of the following according to the output of each of the corresponding said Z Comparators, said Address Compare Unit, and also according to a control input signal:
(i) said old Z value from said Z Memory Array;
(ii) said new Z value from said New Z Values unit;
(iii) said preset value from said Z Preset Register;

(g) a Latch means for storing the data output from said Z Select Unit, wherein said data output from said Z Select Unit is to be written into said Z Memory Array.

4. A Z-Buffer for a Row Addressable Graphics Memory with Flash Fill comprising:

(a) a row addressable Z Memory Array (10);

(b) a New Z Values (11) unit;

(c) a Z Comparators (12);

(d) a Z Preset Register (15);

(e) an Address Compare Units (14);

(f) a Z Select Unit (13);

(g) a Z Latch (16);

whereby (i) said row addressable Z Memory Array (10) stores a plurality of rows of a plurality of Z values, and each Z value is associated with a pixel stored in said Row Addressable Graphics Memory;

(ii) said New Z Values (11) unit has inputs for at least a first Z value data for a start address for a line segment and a second Z value data for an end address for said line segment and comprises a plurality of units for calculating a new Z value for each stage in a selected row, wherein each said new Z value in said New Z Values (11) unit is calculated substantially simultaneously, and wherein said New Z Values (11) unit comprises for said each stage a Subtractor, a Multiplier, and an Adder to perform the equation $$Zn=ZSm+(n-ZSm)*dz,$$

wherein
m is the number of said selected row,
n is the number of said stage,
Zn is the Z value at the nth stage,
ZSm is the Z value at the start of said line segment for row m,
ZEm is the Z value at the end of said line segment for said row m,
XSm is the X value at the start of said line segment for said row m,
XEm is the X value at the end of said line segment for said row m, $$dz=(ZEm-ZSm)/(XEm-XSm);$$

(iii) said Z Comparators (12) compares each said Z value from said each stage in said selected row of said Z Memory Array (10) with each associated said new Z value from said New Z Values (11) unit, wherein said each stage in said selected row of said Z Memory Array (10) is compared simultaneously with each associated said new Z value from said New Z Values (11) unit;

(iv) said Z Preset Register (15) stores a preset value for presetting said Z values in said Z Memory Array (10);

(v) said Address Compare Units (14) has inputs for said start address and said end address of said line segment to be drawn and determines for said each stage whether said stage is within the range of said start address and said end address and further determines whether each said new Z value is to replace each associated old Z value from said Z Memory Array (10) and whether data representing a new pixel is to replace data representing an old pixel;

(vi) said Z Select Unit (13) selects for each of its outputs one of the following according to the output of each of the corresponding comparators in said Z Comparators (12), said Address Compare Units (14), and also according to a control input signal:

(a) said old Z value from said Z Memory Array (10);

(b) said new Z value from said New Z Values (11) unit;

(c) said preset value from said Z Preset Register (15);

(vii) said Z Latch (16) stores the data output from said Z Select Unit (13), wherein said data output from said Z Select Unit (13) is written into said Z Memory Array (10).

5. A Z-Buffer for a Row Addressable Graphics Memory with Flash Fill comprising:

(a) a row addressable Z Memory Array (10);

(b) a New Z Values (11) unit;

(c) a Z Comparators (12);

(d) a Z Preset Register (15);

(e) an Address Compare Units (14);

(f) a Z Select Unit (13);

(g) a Z Latch (16);

whereby (i) said row addressable Z Memory Array (10) stores a plurality of rows of a plurality of Z values, and each Z value is associated with a pixel stored in said Row Addressable Graphics Memory;

(ii) said New Z Values (11) unit has inputs for at least a first Z value data for a start address for a line segment and a second Z value data for an end address for said line segment and comprises a plurality of units for calculating a new Z value for each stage in a selected row, wherein each said new Z value in said New Z Values (11) unit is calculated substantially simultaneously, and wherein said New Z Values (11) unit comprises for each kth stage a Subtractor, a Multiplier, and an Adder to perform the equation $$Zn=ZSm+(n-ZSm)*dz,$$

wherein m is the number of said selected row, n is the number of said stage,

Zn is the Z value at the nth stage,

ZSm is the Z value at the start of said line segment for row m,

ZEm is the Z value at the end of said line segment for said row m,

XSm is the X value at the start of said line segment for said row m,

XEm is the X value at the end of said line segment for said row m, $$dz=(ZEm-ZSm)/(XEm-XSm),$$

and further comprises for every said stage which is not a multiple of k an Adder for adding dz to the output of the previous stage;

(iii) said Z Comparators (12) compares each said Z value from said each stage in said selected row of said Z Memory Array (10) with each associated said new Z value from said New Z Values (11) unit, wherein said each stage in said selected row of said Z Memory Array (10) is compared simultaneously with each associated said new Z value from said New Z Values (11) unit;

(iv) said Z Preset Register (15) stores a preset value for presetting said Z values in said Z Memory Array (10);

(v) said Address Compare Units (14) has inputs for said start address and said end address of said line segment to be drawn and determines for said each stage whether said stage is within the range of said start address and said end address and further determines whether each said new Z value is to replace each associated old Z value from said Z Memory Array (10) and whether data representing a new pixel is to replace data representing an old pixel;

(vi) said Z Select Unit (13) selects for each of its outputs one of the following according to the output of each of the corresponding comparators in said Z Comparators (12), said Address Compare Units (14), and also according to a control input signal:

(a) said old Z value from said Z Memory Array (10);

(b) said new Z value from said New Z Values (11) unit;

(c) said preset value from said Z Preset Register (15);

(vii) said Z Latch (16) stores the data output from said Z Select Unit (13), wherein said data output from said Z Select Unit (13) is written into said Z Memory Array (10).

6. A Z-Buffer for a Row Addressable Graphics Memory with Flash Fill comprising:

(a) a row addressable Z Memory Array (10);

(b) a New Z Values (11) unit;

(c) a Z Comparators (12);

(d) a Z Preset Register (15);

(e) an Address Compare Units (14);

(f) a Z Select Unit (13);

(g) a Z Latch (16);

whereby (i) said row addressable Z Memory Array (10) stores a plurality of rows of a plurality of Z values, and each Z value is associated with a pixel stored in said Row Addressable Graphics Memory;

(ii) said New Z Values (11) unit has inputs for at least a first Z value data for a start address for a line segment and a second Z value data for an end address for said line segment and comprises a plurality of units for calculating a new Z value for each stage in a selected row, wherein each said new Z value in said New Z Values (11) unit is calculated substantially simultaneously, and wherein said New Z Values (11) unit comprises for each kth stage a Subtractor and at least one Adder to perform the equation Zn=KZ+Wn, wherein m is the number of said selected row, n is the number of said stage, Zn is the Z value at the nth stage, ZSm is the Z value at the start of said line segment for row m, ZEm is the Z value at the end of said line segment for said row m, XSm is the X value at the start of said line segment for said row m, XEm is the X value at the end of said line segment for said row m, $$KZ=ZSm-XSm*dz,$$

$$dz=(ZEm-ZSm)/(XEm-XSm),$$

$$Wn=w0*1*dz+w1*2*dz+w2*4*dz+w3*8*dz+\ldots+wj*bj*dz,$$

wherein bj is a binary power of 2 (1,2,4,8,16,32, . . . ), wj is either 0 or 1, such that $$w0*1+w1*2+w2*4+w3*8+\ldots+wj*bj=n,$$

and further comprises for every said stage which is not a multiple of k an Adder for adding dz to the output of the previous stage;

(iii) said Z Comparators (12) compares each said Z value from said each stage in said selected row of said Z Memory Array (10) with each associated said new Z value from said New Z Values (11) unit, wherein said each stage in said selected row of said Z Memory Array (10) is compared simultaneously with each associated said new Z value from said New Z Values (11) unit;

(iv) said Z Preset Register (15) stores a preset value for presetting said Z values in said Z Memory Array (10);

(v) said Address Compare Units (14) has inputs for said start address and said end address of said line segment to be drawn and determines for said each stage whether said stage is within the range of said start address and said end address and further determines whether each said new Z value is to replace each associated old Z value from said Z Memory Array (10) and whether data representing a new pixel is to replace data representing an old pixel;

(vi) said Z Select Unit (13) selects for each of its outputs one of the following according to the output of each of the corresponding comparators in said Z Comparators (12), said Address Compare Units (14), and also according to a control input signal:

(a) said old Z value from said Z Memory Array (10);

(b) said new Z value from said New Z Values (11) unit;

(c) said preset value from said Z Preset Register (15);

(vii) said Z Latch (16) stores the data output from said Z Select Unit (13), wherein said data output from said Z Select Unit (13) is written into said Z Memory Array (10).

7. A method for integrating a Z-Buffer with a Row Addressable Graphics Memory with Flash Fill comprising the steps of:

(a) storing a plurality of rows of a plurality of Z values in a row addressable Z Memory Array, wherein each Z value is associated with a pixel stored in said Row Addressable Graphics Memory;

(b) calculating a new Z value for each stage in a New Z Values unit using at least a first Z value data for a start address for a line segment and a second Z value data for an end address for said line segment, wherein each said new Z value in said New Z Values unit is calculated substantially simultaneously;

(c) comparing each said Z value from said each stage in a selected row of said Z Memory Array with each associated said new Z value in said New Z Values unit, wherein the comparators of said each stage in said selected row operate simultaneously;

(d) storing in a Register means a preset value for presetting said Z values for said Z Memory Array;

(e) determining, in an Address Compare Unit, whether each said stage is within the range of said start address and said end address and further determining whether each said new Z value is to replace each associated old Z value from said Z Memory Array and whether data representing a new pixel is to replace data representing an old pixel;

(f) selecting for each output of a Z Select Unit one of the following according to the output of each of the corresponding said comparators, said Address Compare unit, and also according to a control input signal:

(i) said old Z value from said Z Memory Array;

(ii) said new Z value from said New Z Values unit;

(iii) said preset value from said Z Preset Register;

(g) storing the data output from said Z Select Unit in a Latch means, wherein said data output from said Z Select Unit is to be written into said Z Memory Array.

8. The method of claim 7 wherein the method for calculating said new Z value for each said stage in said New Z Values unit comprises the steps of performing the calculation Zn=ZSm+(n−ZSm)*dz, wherein m is the number of said selected row, n is the number of said stage, n is the Z value at the nth stage, ZSm is the Z value at the start of said line segment for row m, ZEm is the Z value at the end of said line segment for said row m, XSm is the X value at the start of said line segment for said row m, XEm is the X value at the end of said line segment for said row m, $$dz=(ZEm-ZSm)/(XEm-XSm).$$

9. The method of claim 7 wherein the method for calculating said new Z value for each said stage in said New Z Values unit comprises the steps of (a) for every kth stage performing the calculation $$Zn=ZSm+(n-ZSm)*dz,$$

wherein m is the number of said selected row, n is the number of said stage,

Zn is the Z value at the nth stage,

ZSm is the Z value at the start of said line segment for row m,

ZEm is the Z value at the end of said line segment for said row m,

XSm is the X value at the start of said line segment for said row m,

XEm is the X value at the end of said line segment for said row m, $$dz=(ZEm-ZSm)/(XEm-XSm),$$

(b) for every said stage which is not a multiple of k, adding dz to the output of the previous stage.

10. The method of claim 7 wherein the method for calculating said new Z value for each said stage in said New Z Values unit comprises the steps of (a) for every kth stage performing the calculation $$Zn=KZ+Wn,$$

wherein m is the number of said selected row, n is the number of said stage,

Zn is the Z value at the nth stage,

ZSm is the Z value at the start of said line segment for row m,

ZEm is the Z value at the end of said line segment for said row m,

XSm is the X value at the start of said line segment for said row m,

XEm is the X value at the end of said line segment for said row m, $$KZ=ZSm-XSm*dz,$$

$$dz=(ZEm-ZSm)/(XEm-XSm),$$

$$Wn=w0*1*dz+w1*2*dz+w2*4*dz+w3*8*dz+\ldots+wj*bj*dz,$$

wherein bj is a binary power of 2 (1,2,4,8,16,32 . . . ), wj is either 0 or 1, such that $$w0*1+w1*2+w2*4+w3*8+\ldots+wj*bj=n;$$

(b) for every said stage which is not a multiple of k, adding dz to the output of the previous stage.

* * * * *